US009919337B1

(12) United States Patent
Decker

(10) Patent No.: US 9,919,337 B1
(45) Date of Patent: Mar. 20, 2018

(54) COATING APPLICATION SYSTEM AND METHOD OF USE

(71) Applicant: Owen H. Decker, Smithville, MO (US)

(72) Inventor: Owen H. Decker, Smithville, MO (US)

( * ) Notice: Subject to any disclaimer, the term of this patent is extended or adjusted under 35 U.S.C. 154(b) by 21 days.

(21) Appl. No.: 15/078,471

(22) Filed: Mar. 23, 2016

Related U.S. Application Data

(60) Provisional application No. 62/136,655, filed on Mar. 23, 2015.

(51) Int. Cl.
*B05C 19/00* (2006.01)
*B05C 19/02* (2006.01)

(52) U.S. Cl.
CPC ..... *B05C 19/02* (2013.01); *B05C 19/00* (2013.01)

(58) Field of Classification Search
USPC ..... 118/308, 620–640, 303; 239/693, 239/704–708
See application file for complete search history.

(56) References Cited

U.S. PATENT DOCUMENTS 3,724,755 A * 4/1973 Diamond ..... B05B 5/1683 239/693
3,870,375 A * 3/1975 Duncan ..... B05B 5/1683 239/695
4,824,295 A * 4/1989 Sharpless ..... B05B 7/1404 118/312
5,849,051 A * 12/1998 Beardsley ..... B24D 3/32 51/295
2008/0032060 A1* 2/2008 Nesbitt ..... A47J 36/025 427/470

* cited by examiner

*Primary Examiner* — Yewebdar T Tadesse
(74) *Attorney, Agent, or Firm* — Richard G. Eldredge; Eldredge Law Firm

(57) ABSTRACT

A confluent system includes an internal venturi; an open hopper in gaseous communication with the internal venturi, the open hopper being configured to receive solid large particles; and a fluid bed in gaseous communication with the internal venturi. The method includes a set of coatings and composite structures formed from a portion of the solid large particles applied to workpieces by gas-supported transfer then fused together by heating that comprise large-scale variations in structure provided by the inclusion of particles that are larger in at least one dimension than conventional powder coating particles.

7 Claims, 13 Drawing Sheets

Table 1

| Conventional Particle (As Spheres) | |
|---|---|
| Spherical Diameter | $S_v$ |
| 1 | 6.000 |
| 5 | 1.200 |
| 10 | 0.600 |
| 25 | 0.240 |
| 35 | 0.171 |
| 50 | 0.120 |
| 75 | 0.080 |
| 100 | 0.060 |
| 150 | 0.040 |
| 200 | 0.030 |
| 250 | 0.024 |

FIG. 21

Table 2

| Conventional Particle (Sphere) | | Inventive Fiber Form Megaparticles (Round Cross Section) | Inventive Fiber Form Megaparticles (Square Cross Section) |
|---|---|---|---|
| Spherical Diameter | $S_v$ | Diameter with Same $S_v$ as Conventional Particles (um) | Side Length with the Same $S_v$ as Conventional Particles (um) |
| 1 | 6.000 | 0.667 | 0.667 |
| 5 | 1.200 | 3.33 | 3.33 |
| 10 | 0.600 | 6.67 | 6.67 |
| 25 | 0.240 | 16.7 | 16.7 |
| 35 | 0.171 | 23.3 | 23.3 |
| 50 | 0.120 | 33.3 | 33.3 |
| 75 | 0.080 | 50.0 | 50.0 |
| 100 | 0.060 | 66.7 | 66.7 |
| 150 | 0.040 | 100 | 100 |
| 200 | 0.030 | 133 | 133 |
| 250 | 0.024 | 167 | 167 |

FIG. 22

Table 3

| Conventional Particle (Sphere) | | Plate Form (Disc) | Plate Form (Square Plane) |
|---|---|---|---|
| Spherical Diameter | Sv | Thickness With the Same Sv (um) | Thickness With the Same Sv (um) |
| 1 | 6.000 | 0.333 | 0.333 |
| 5 | 1.200 | 1.67 | 1.67 |
| 10 | 0.600 | 3.33 | 3.33 |
| 25 | 0.240 | 8.33 | 8.33 |
| 35 | 0.171 | 11.7 | 11.7 |
| 50 | 0.120 | 16.7 | 16.7 |
| 75 | 0.080 | 25.0 | 25.0 |
| 100 | 0.060 | 33.3 | 33.3 |
| 150 | 0.040 | 50.0 | 50.0 |
| 200 | 0.030 | 66.7 | 66.7 |
| 250 | 0.024 | 83.3 | 83.3 |

FIG. 23

Table 4

Example Inventive Crumb-Form Megaparticles

| Spherical Diameter of Conventional Particle (μ) | Conventional Particle Volume-Specific Surface Area ($S_V$) | Crumb-Form Particle Diameter (μ) | Crumb-Form Particle Void Fraction (%) | Crumb-Form Particle's Mass-Multiple of Conventional Particle (X) |
|---|---|---|---|---|
| 150 u | 0.040 | 300 | 50 | 4 |
| 50 | 0.12 | 500 | 90 | 100 |
| 250 | 0.024 | 5000 | 95 | 400 |

FIG. 24

COATING APPLICATION SYSTEM AND METHOD OF USE

BACKGROUND

1. Field of the Invention

The present invention relates generally to particle coating application systems and methods of use.

2. Description of Related Art

Powder Coating Technology—

Powder coating technology, in which tiny particles of solid paint are applied to workpieces, then heated to melt, flow and cure to beautiful protective films, is successful and widely used. This technology may be used to produce hard, corrosion-resistant films from a variety of polymer types, and in a wide variety of colors.

Powder coating technology, however, is limited. Tiny solid paint particles are easy to blow through a spray gun and charge electrostatically so that they are attracted to grounded metal parts. However, as every powder coating manufacturer and every powder user knows, coating particles larger than about 250 microns can't be applied by conventional powder application systems. Consequently, powder coating manufacture is conventionally directed toward producing particles between about 10 and 100 microns in diameter or typical size. Powder applications systems are likewise optimized to apply particles in the same size range.

Limitations of Powder Coatings—

The small size of conventional powder coating particles limits the types of films that are designed and applied. Speckled coatings are produced, but coatings with variations in color or pattern larger than can be produced by 100 micron, or 250 micron particles are not produced. Examples of this type of coating include, for example, coatings with the large scale variations of color and pattern seen in granite or other natural stone. Printed words are never applied by powder coating, and neither are corporate logos. Pink hearts or goldfish are never applied, and the technology is not used to affix polka dots, rainbows, or any or any other such device.

Composites Inaccessible—

Fiber-reinforced composite structures are also inaccessible via conventional powder coating technology. The mechanical strength of composites materials is conferred by their structure, which consists of strong fibers bound in an adhesive matrix. The 250 micron size limitation of conventional powder coatings precludes the technology from applying films, or related composite structures containing fibers longer than about 250 microns in length. We set out to overcome the limitations imposed by the small size of conventional powder coating particles. It is a primary object of the invention to provide an application system that can apply large particles such as fibers, flakes and foam, and intermediate forms. It is a further object of the invention is to provide a system that can apply large and small particles.

Controlled Proportions—

Systems that produced multi-color films of decorative value conventionally include the capacity to control the size and relative quantities of differently-colored particles. Similarly, composite structures are generally fabricated with a controlled ratio of fiber and matrix material. It is a further object of the invention to provide a particle application system that can supply different types of large and small particles in controlled proportions.

Blended Powder Coatings—

A familiar design aim of conventional powder coatings is to produce variation in color or appearance. A traditional approach is to independently prepare two, three or even more types of small particles, then to blend them together in controlled proportions. The technique is not limited to blends of fully-formulated coating powders, but includes blends of fully or partially-formulated coating powders with other fully or partially-formulated coating powders, or with coating components, such as pigments, curing agents and cratering aids. In a variation of this process, the blend may be "bonded" by a combination of mechanical impacts and heat, to form agglomerates of the blend components. A typical example of this approach is to bond metal flake pigments to film-forming particles. The bonding process, an added step in powder manufacture, is undertaken minimize the ubiquitous defect of blended coatings, segregation.

Segregation of Blended Particles—

Segregation is the well-known tendency of solid particles to sort themselves into like groups when moved. Under the influence of vibration, small particles may fall though a blend of large and small particles, collecting at the bottom of a container. Similarly, blends of powder particles of different specific gravity or size may stratify themselves in a fluid bed, such that the material discharged from the bed changes in composition over time. Similarly, sprayed powder may segregate in an electrostatic field, leading to uneven deposition and variations in color, or other properties.

Enhanced Segregation of Particles of Differing Size, Shape and Composition—

One approach to providing a particle application system that can supply different types of large and small particles in controlled proportions is to prepare blends of differing particles in the desired proportion, then apply the blends though a simple application system. This approach is one of the embodiments of the invention. However, differences in size shape, and compositions of the magnitude contemplated in this disclosure might produce damaging segregation of a blended compositions applied through a delivery system that controlled only the delivery rate of the blend. Accordingly, it is an object of the invention to provide particle application systems that deliver different types of particles at different controlled rates.

Particle Delivery Systems—

Systems for delivering particles at a controlled rate to a workpiece are well known in the art, and include systems for delivering liquid droplets, for delivering small solid particles, and for delivering large solid particles.

Systems for Delivering Liquid Particles—

Systems for delivering liquid droplets, either electrically charged or uncharged, are conventionally used to apply liquid paint, and are distinct from the inventions of this disclosure, which are purposed to apply particles that have solid exterior surfaces.

Systems for Delivering Small Solid Particles—

Systems for delivering small particles at controlled rates are well known in the art. Among these systems, those for applying powder coatings are especially well developed and represented both in the patent literature and in commercial use. Important variants of these systems include: systems that supply powder particles on a stream of air delivered through a powder gun, powder disc, or powder bell; systems that dispense powder into a gas-filled chamber from a hopper by means of a rotating brush; and systems in which a shot of gas-fluidized powder is blown through a pre-heated pipe by application of a high-capacity vacuum at the downstream end.

To facilitate deposition of the powder particles on workpieces, coating particles may be electrostatically charged, and may be applied to electrically conductive workpieces that are grounded. Workpieces may be highly conductive metal articles, or plastics with a surface layer of conductive materials, but it is also known to powder coat materials such as medium density fiberboard that are merely charge dissipative and it has even been found possible to powder coat cold non-conductive materials that have collected a surface layer of moisture by condensation from a warm, moist atmosphere. Non-conductive workpieces may be coated if they are heated so that impinging powder particles melt and adhere.

Spray Guns, Disc and Bells—

Several types of systems are known that supply powder particles on a stream of gas, including, for example, systems delivered through a powder spray gun, powder disc, or powder bell.

Systems that supply powder particles on a stream of air delivered through a powder gun, powder disc, or powder bell typically comprise the following parts: (a) an entrainment zone where the particles become suspended in a flow of air; (b) an air supply to create the flow of air; (c) an outlet nozzle to direct the stream of air and particles toward a work-piece; (d) tubing to connect the air supply, the entrainment zone and the nozzle; (e) optionally one or more high voltage electrodes positioned in or near the flow of gas in the nozzle to create charged species in the air and on the particles carried in the air flow.

Limitations of Systems for Applying Small Particles—

Although conventional powder coating systems are efficient at applying small particles, they are not adapted to applying large particles, those with at least one dimension larger than about 250 microns. The design and operation of several principal subsystems of conventional systems for applying small particles make them unsuited for applying large particles. Problematic subsystem include: (a) the means for entraining the small particles in air, (b) internal air supply or venturi pumps of conventional design, (c) conventional spray nozzle design, (d) the routine use of tubing of small diameter, and (e) the conventional design and placement of high voltage electrodes.

The Entrainment Zone—

Devices used conventionally for entraining powder in air include, among others, the following: filled hopper feed into an entrainment zone of flowing air, fluidizing beds, and air-assisted vacuums.

Filled Hopper Feed—

Small particles may be entrained in a flow of air by filled hopper feed. In this method a funnel or hopper having an open bottom or outlet port and containing a quantity of powder particles is positioned above and connected to an opening in a receiving tube containing a flow of air. Gravity draws small particles from the hopper into the air stream. Air is also drawn from the hopper by the venturi effect of the air flow in the receiving tube. This flow of air from the hopper has a strong metering effect on the flow rate of small particles from the hopper.

A typical example of conventional systems which suspend small particles in air by filled hopper feed is the powder coating cup gun. In a conventional cup gun the orifice at the bottom of the feed funnel is about three millimeters in diameter. Calculating from the average mean diameter of conventional powder particles of forty microns, the feed funnel orifice is about seventy-five times as large as a typical powder particle. Despite this relatively large orifice, the flow rate of the air in the receiving tube controls the flow rate of particles from the funnel by controlling the flow rate of air from the funnel.

The rate of filled hopper feed of larger particles is much less dependent on hopper air flow than is than hopper feed of small particles. Hoppers for larger diameter particles conventionally operate efficiently at orifice-to-particle diameter ratios of less than 10, and sometimes as low as 2.5. The flow rate of large particles is so much less dependent on the flow rate of air from the hopper that they are conventionally used to feed systems such as screw conveyers that provide negligible air flow. Hoppers may even be operated in closed condition with negative net air flow through the orifice. In consequence of the relatively efficient flow of large particles though hoppers, and the independence of particle delivery rate on air flow, hopper feed of large particles requires a means of rate control other than air flow past the hopper orifice in the receiving tube. It is an object of the invention to provide hopper feed systems with a positive means of feed rate control.

Fluidizing Beds—

One widely-used conventional device for suspending small particles in air is the fluidizing bed. A fluid bed of powder is conventionally created in a container with a porous bottom through which air is forced. When a quantity of powder is placed in the container, air flowing through the porous bottom lifts and separates the particles, creating an air/powder mixture that has fluid-like properties. For example, it is uniform in composition, may be poured, and may be drawn into orifices such as the mouths of tubing held at lower pressure than that in the fluid bed.

Fluidizing beds are sometimes found to be less useful for larger particles, particularly large fibers and large flakes. Large fibers are those particles with length greater than 250 microns and no other dimension more than about one-third of the length. Large flakes are those particles with two dimensions greater than 250 microns and a third dimension no more than about one-third of the other two. Physical contacts between these larger particles restrict their independent motion in a manner that can cause a fluid bed to form channels and to collapse, preventing the formation of dense-phase, pumpable suspensions of large fibers or of large flakes in air.

In contrast to the behavior of large fibers and large flakes, large foam particles, that is, those with three dimensions greater than 250 microns, but of reduced density because of the inclusion of gas or vacuum-filled voids, reliably form a dense-phase pumpable suspensions resembling fluidized powder.

Air-Assisted Vacuum—

The air-assisted vacuum is another device used to create suspensions of small particles in air. In this device, a flow of air directed from an air supply into a non-fluidized bed of powder particles locally disrupts the powder bed, and creates a local suspension of powder particles in air. A receiving tube with an opening held at a pressure lower than that of the powder suspension is fixed near the air supply tube in such a manner that the opening of the receiving tube is inside the powder suspension, and consequently the suspension of powder in air is drawn into the tube.

Like the fluid bed, the air-assisted vacuum is less useful for suspending large fibers and large flakes in air than for suspending small particles. Physical contacts between particles restrict their independent motion in a manner that prevents the formation of pumpable suspensions. Large foam particles with low-enough density may be suspended by this means.

Air Supply—

Conventional systems for delivering suspensions of small particles in air include at least one air supply system. These conventional systems are typically linked to the overall system in one of two ways: (1) by attaching the air supply to the upstream end, and (2) by attaching the air supply to the interior of the system in such a way that it drives a venturi pump which draws the suspension of small particles in air through a feed tube, passes it through the venturi chamber, and is expels it through an outlet tube.

Upstream Air Supply—

In systems with an upstream air supply, the air supply is connected by a section of tubing to the delivery nozzle, and an opening is provided in the tubing to create a particle entrainment zone. A familiar example of this system is the hopper spray gun, depicted in FIG. 1. Air from the upstream air supply 1 is directed into the delivery tube 2 leading to the spray nozzle assembly 3 of the gun. A particle entrainment zone 4 is created by providing an opening in the side of the tube, to which is connected a powder-filled funnel 5. In operation, air and powder from the funnel is drawn into the delivery tube at a controlled rate by the passing stream of air according to the venturi effect. Air and powder particles exiting from the nozzle may be charged electrostatically by means of a high voltage electrode 6 positioned in or near the spray nozzle.

This type of system is convenient for spraying powder coatings, especially in a laboratory setting where only small quantities of powder are sprayed. As described above, however, filled hopper feed of larger particles is not controlled by the flow rate of the air in the receiving tube, and must be independently controlled.

In-Stream Air Supply—

In systems with an in-stream air supply, a venturi pump driven by the air supply is connected to both a feed tube and an outlet tube. A depiction of this type of system is provided as FIG. 2. In this type of system, a particle entrainment zone 7 is provided at the upstream end of the particle delivery tube 8, and a spray nozzle/high voltage electrode assembly 9 is connected to the downstream end of the outlet tubing. The flow of suspended small particles must pass through the venturi pump 10. The conventional design of this pump includes a small diameter pumping tube 11 that carries a flow of high velocity air from an air supply 12 into the venturi pump 10, drawing the air/particle mixture up the particle delivery tube 8.

Conventional pumps are built to transfer coating powders comprised of particles between about 1 and about 250 microns in diameter, with a typical mean particle diameter of about 40 microns. Because they are used to pump suspensions of small particles, clearances inside conventional venturi pumps may also be small, and are generally less than about 6 mm. Such pumps are easily clogged by particles larger than about 250 microns in largest dimension, and are particularly unsuited for fiber or flake particles with largest dimension over a few millimeters. Besides partially obstructing the particle passage, the venturi pump design of FIG. 2 creates a region of high shear in the venturi pump 10 which can damage large and fragile particles.

Spray Nozzle—

A spray nozzle is conventionally affixed to the outlet nozzle of systems for delivering suspensions of small particles in air. Nozzles of various shapes have been developed to shape the exiting particle/gas suspension. Rotating means may be added to distribute powder particles. Clearances for the passage of particle/gas suspension in various nozzle designs used for powder coatings are generally less than about six mm, and may be as little as three mm. One or more high voltage electrodes 6 are commonly placed inside or adjacent to the nozzle as depicted in FIG. 1.

Delivery Tubing—

In conventional powder devices, the delivery tubes that carry the air/powder suspension are typically between about 9 and 12 mm (about ⅜ to ½-inch) in diameter. These powder delivery tubes are depicted in FIG. 1 and FIG. 2. As is true of the small passage clearances inside the venturi pump, this small diameter restricts the size of particles that the tubing can carry.

High Voltage Electrode—

One or more electrodes, charged to a potential of between about 20,000 and about 130,000 volts, are conventionally positioned inside or adjacent to the nozzle where the suspension of powder in air exits the system. These electrodes may be positioned at the edges of the air stream, but are commonly placed in the stream as depicted in FIG. 1 and FIG. 2. This placement can restrict the size of the opening, restricting the size of particles that the system can deliver.

Systems that Dispense Powder into a Gas-Filled Chamber from a Hopper by Means of a Rotating Brush—

U.S. Pat. No. 6,875,278 discloses systems for dispersing electrostatically-charged coating powders in a closed chamber to coat steel coils. These systems for delivering small particles at controlled rate are comprised of the following parts: (a) means for delivering powder at a controlled rate to a dispersion hopper, (b) a dispersion hopper with a rotating brush to create a powder cloud (c) a chamber to contain the powder cloud, (d) one or more high voltage electrodes to impart an electrostatic charge to the powder cloud. When a sheet of conductive, grounded substrate, such as a sheet of steel is passed through the chamber, powder from the cloud is deposited thereon. Such systems have not been adapted to supplying large particles, or to supplying blends of large and of small particles. It is an object of the invention to adapt such systems to the application of large particles and to the application of large and small particles at different, controlled rates.

Systems in which a Shot of Air-Fluidized Powder is Blown Though a Pre-Heated Pipe—

As disclosed in U.S. Pat. No. 4,698,241 systems in which a shot of gas-fluidized powder is blown through a pre-heated pipe by opening of a high-capacity vacuum at the downstream end are conventionally used to apply powder coatings to the interior of pipe. Versions are known which deposit a more even film by sequentially introducing a shot of gas-fluidized powder from first one end, then the other end of the pipe. It is an object of the invention to adapt such systems to the application of large particles and to the application of large and small particles at different, controlled rates.

Systems for Delivering Large Particles—

Systems for delivering large particles at a controlled rate to a workpiece, are represented by systems for delivering fiber particles. Two types of systems for delivering fiber particles at a controlled rate to a workpiece are fiber chopping systems used in the composites industry, and systems designed to apply flocking.

Fiber Chopping Systems—

Fiber chopping systems are conventionally used to manufacture fiber/matrix composites by delivering chopped roving to workpieces that have previously been coated with a layer of curable liquid polymer.

Flocking Systems—

Similarly, flocking systems deliver large fiber particles to workpieces that have previously been coated with liquid adhesive. In flocking systems, the application system conventionally creates an electrostatic charge on the flock fibers, such that they may arrive at the workpiece end on, and to stick up after application. Although flocking systems that apply electrostatically-charged fiber particles up to several millimeters in length to electrically dissipative, liquid adhesive surfaces are known, systems for applying fiber particles longer than about 250 microns and up to several centimeters in length to solid surfaces, whether electrically conductive, electrically dissipative or non-conductive, and whether heated or unheated are not known. It is an object of the invention to provide a system that can deliver fiber particles, and optionally, other solid particles, at controlled rates to workpieces that have not previously been coated with a liquid adhesive.

Systems for Delivering Flake Particles—

Systems for delivering flake particles of the current invention at a controlled rate to a workpiece, whether electrically conductive, electrically dissipative or non-conductive, and whether heated or unheated, are not well known in the art. It is an object of the invention to provide a system that can deliver flake particles, and optionally, other solid particles, at controlled rates to workpieces.

Systems for Delivering Foam Particles—

Systems for delivering foam particles of the current invention at a controlled rate to a workpiece, whether electrically conductive, electrically dissipative or non-conductive, and whether heated or unheated, are not well known in the art. It is an object of the invention to provide a system that can deliver foam particles, and optionally, other solid particles, at controlled rates to workpieces.

Although great strides have been made in the area of particle application systems, many shortcomings remain.

BRIEF SUMMARY OF THE INVENTION

The invention is a means of applying coating films and related composite structures. It comprises a system that can supply one or more types of large solid precursor particles, including fiber, flake, and foam particles, and particles of intermediate form, to workpieces at controlled rates. A further elaboration of the invention as a means of applying coating films and related composite structures is a system that comprises (a) a subsystem that can supply one or more types of large solid precursor particles, including fiber, flake, and foam particles, and particles of intermediate form to a workpiece at a controlled rate, and (b) a second subsystem that can supply one or more types of small particle at controlled rates to the same workpiece.

The system may optionally include means for imparting an electrostatic charge to the large particles, and independently may optionally include means for imparting an electrostatic charge to the small particles. The streams of large and small particles may arrive at the workpiece separately, or optionally they may converge before they impinge on the workpiece. The workpiece may optionally be heated and may optionally be electrically dissipative and grounded.

In this disclosure "small" solid particles are particles in the size range of conventional powder coatings, ranging in diameter or typical dimension from about 1 to about 250 microns, and especially between about 10 and 100 microns. Most powder coating samples have a mean particle size ranging between about 20 and about 60 microns, and averaging about 40 microns. In contrast, "large" particles are those with at least one dimension larger than 250 microns. Such particles include, for example, fibers longer than 250 microns and up to lengths of several centimeters; flat flake or film particles with lengths and widths larger than about 250 microns and up to lengths and widths of several centimeters; and foam particles larger than about 250 microns and up to several centimeters in three dimensions, but of reduced density because of the inclusion of a substantial fraction of gas voids. They also include intermediate forms between these extremes.

"Solid" particles are particles with solid exterior surfaces, as opposed to liquid surfaces. Although they have solid surfaces, solid particles may contain gas voids, or liquid inclusions.

The systems of the invention for applying both small and large particles may be organized in several ways. In one version, depicted in FIG. 3, there are one or more subsystems that deliver large particles 13 at a controlled rate to a workpiece 14, and one or more other subsystems that delivers small particles 15 at a controlled rate to the same workpiece. The subsystems may operate at the same time, or at different times, or at different rates, providing means of varying the composition of the deposited particle bed. Optionally, only one subsystem may operate so that the overall system delivers only one type of particle.

In another version, depicted in FIG. 4, one or more subsystems that deliver large particles 16 at a controlled rate and one or more subsystems that deliver small particles 17 at a controlled rate converge into a single combined system 18 flow before impinging on the workpiece. Elements for feeding and conveying different types of particles inside the overall system may be operated at different times or at different rates, providing means of varying the composition of the deposited particle bed. Optionally, some elements may be turned off so that the overall system delivers only one type of particle.

Subsystems for Supplying Small Particles—Powder Guns, Discs and Bells—

A preferred type of subsystem for supplying streams of small particles is variously known conventionally as a powder gun, powder disc, or powder bell, and comprises the following parts: (a) an entrainment zone where the particles become suspended in a flow of air; (b) an air supply means to create the flow of air; (c) an outlet nozzle to direct the stream of air and small particles toward a work-piece; (d) tubing to connect the air supply, the entrainment zone and the nozzle; (e) optionally one or more high voltage electrodes positioned in or near the flow of air in the nozzle to create charged species in the air and on the particles carried in the air flow.

Systems that Dispense Powder into a Gas-Filled Chamber from a Hopper by Means of a Rotating Brush—

Another type of subsystem for applying small particles functions by dispersing electrostatically-charged coating powders in a closed chamber, and is comprised of the following parts: (a) means for delivering powder at a controlled rate to a dispersion hopper, (b) a dispersion hopper with a rotating brush to create a powder cloud (c) a chamber to contain the powder cloud, (d) one or more high voltage electrodes to impart an electrostatic charge to the powder cloud. When a sheet of conductive, grounded substrate, such as a sheet of steel is passed through the chamber, powder from the cloud is deposited thereon.

Systems in which a Shot of Air-Fluidized Powder is Sucked Though a Pre-Heated Pipe—

Another type of subsystem for applying small particles functions by sucking a shot of gas-fluidized powder through a pre-heated pipe by application of a high-capacity vacuum at the downstream end of the pipe. Versions are known which deposit a more even film by sequentially drawing a shot of gas-fluidized powder through the pipe first from one end, then by drawing another shot of gas-fluidized powder through the pipe from the other end.

Subsystems for Supplying Large Particles—Large Particle Guns, Discs and Bells—

A preferred type of subsystem for supplying streams of large particles on air comprises the following parts common to small particle systems: (a) an entrainment zone where the particles become suspended in a flow of air; (b) an air supply means to create the flow of air; (c) an outlet nozzle to direct the stream of air and large particles toward a work-piece; (d) tubing to connect the air supply, the entrainment zone and the nozzle; (e) optionally one or more high voltage electrodes positioned in or near the flow of gas in the nozzle to create charged species in the air and on the large particles carried in the air flow. In addition, this preferred type of subsystem comprises means for delivering large particles at controlled rate to the entrainment zone. The various elements of the system for delivering large particles may be modified to increase the size of internal passageways and clearances.

Systems that Dispense Large Particles into a Gas-Filled Chamber from a Hopper by Means of a Rotating Brush—

Another type of subsystem for applying large particles functions by dispersing electrostatically-charged large particles in a chamber, and is comprised of the following parts: (a) means for delivering large particles at a controlled rate to a dispersion hopper, (b) a dispersion hopper with a rotating brush to disperse the large particles at a controlled rate (c) a chamber to contain the dispersed large particles, (d) one or more high voltage electrodes to impart an electrostatic charge to the dispersed large particles. When a sheet of conductive, grounded substrate, such as a sheet of steel is passed through the chamber, large particles are deposited thereon.

Systems in which a Shot of Air-Fluidized Large Particles is Blown Though a Pre-Heated Pipe—

Another type of subsystem for applying large particles to the interior of pipe functions by drawing a shot of large particles suspended on air through a pre-heated pipe by application of a high-capacity vacuum at the downstream end of the pipe. Versions are contemplated which deposit a more even film by sequentially introducing a shot of gas-fluidized large particles from first one end, then the other end of the pipe.

Application of Different Particles Using Discrete Subsystems—

Systems for delivering the same type of small particle, powder guns for example, may conventionally be operated singly, or may be operated in groups of two or more. An embodiment of the invention is to coordinate the operation of one or more subsystems that deliver one type of particle to a workpiece with the operation of one more subsystems that deliver another type of particle to the workpiece. Particles delivered by the distinct subsystems may differ in one or many ways, for example size, shape, density, color, composition, tendency to accumulate electrostatic charge, etc.

A preferred means of coordinating the operation of subsystems that deliver different types of particles is to provide a separate subsystem for delivering each type of particle. For example, a spray gun, disc or bell adapted to delivering large particles at a controlled rate may be directed toward a workpiece, while a second spray gun, disc or bell adapted to delivering small particles at a second controlled rate or to delivering a different type of large particles at a second controlled rate is directed toward the same workpiece.

Similarly, two or more discrete systems that dispense particles into a gas-filled chamber from a hopper by means of a rotating brush may be operated in the same chamber. One or more systems might, for example, be adapted to delivering large particles, while one or more other systems might be adapted to delivering small particles, or another type of large particles.

Similarly, two or more discrete systems for coating the inside of preheated pipe might be operated one after another to deposit differing types of particles inside the pipe.

Application of Different Particles Using Joined Subsystems—

Many of the elements of subsystems for delivering one type of large particle have the same form and function as elements of subsystems for delivering another type of large particle, or for delivering small particles. In systems designed to deliver more than one type of particle, it is an embodiment of the invention to merge subsystems where common elements can be shared. We have found, however, that the ultimate composition of a deposited coating or related composite structure is most easily controlled if the rate at which each type of particle is supplied is independently controlled. Independent control is best accomplished by providing a separate means for determining the rate of each type of particle that is included in a single coating film or related composite structure.

For example, a subsystem for supplying large particles to a spray gun, disc or bell at a controlled rate may be merged with a subsystem for supplying small particles to a spray gun, disc or bell in that the following elements be shared: an air supply means to create the flow of air; an outlet nozzle to direct the stream of air, large particles and small particles toward a work-piece; tubing to connect the air supply, the particle entrainment zones and the nozzle; and one or more high voltage electrodes positioned in or near the flow of gas in the nozzle to create charged species in the air and on the large and small particles carried in the air flow. Rate suppling means, however, and the associated particle entrainment zones, however, are not shared. If, for example, the small particles are supplied in a fluid bed, the rate of small particle supply is determined by controlling the air flow rate at the entrainment zone, the opening of the system feed tube into the fluidized material. Large particles may be independently supplied to the system, for example, through an open hopper connected to an opening in the side of the system tubing, at a rate controlled by a feeder. This example, and other versions of merged systems for supplying differing particles will be described hereinafter in more detail.

A second embodiment of the invention is a method of forming coatings and composite structures having large-scale variations in structure by gas-supported transfer of a particle set that includes some particles larger than conventional powder coating particles, and may include conventional powder coating particles.

The invention is further embodied by the forms and compositions of the large particles that may be applied by gas-supported transfer to form coatings and composite structures having large-scale variations in structure.

The invention is further embodied by the methods used to prepare the large particles that may be applied by gas-supported transfer to form coatings and composite structures having large-scale variations in structure.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

FIGS. 21-24 are tables the characteristic of the materials used in the various embodiments of the present application.

Figure 1:
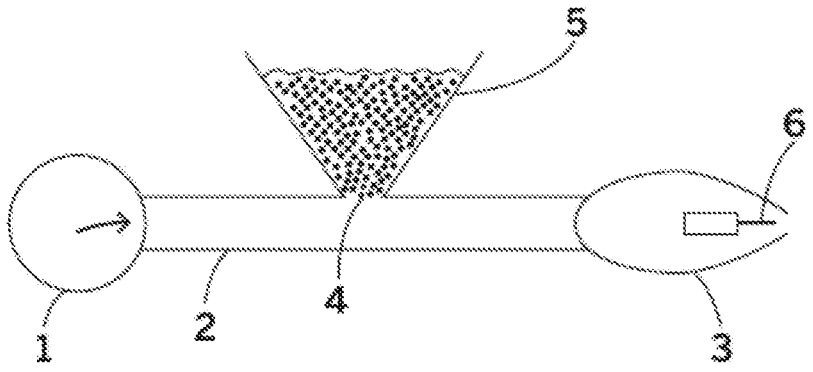
FIG. 1 (Prior Art)
FIGS. 1 and 2 are simplified front view schematics of conventional coating systems.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Definitions

In this disclosure "small" solid particles are particles in the size range of conventional powder coatings, ranging in diameter or typical dimension from about 1 to about 250 microns, and especially between about 10 and 100 microns. Most powder coating samples have a mean particle size ranging between about 20 to about 60 microns, and averaging about 40 microns. In this disclosure, the terms "small solid particles," "small particles," and "powder" are used interchangeably. Modified versions such as "small charged particles" and "charged powder" may also be used interchangeably.

In contrast, "large" particles are those with at least one dimension larger than 250 microns. Such particles include, for example, fibers longer than 250 microns and up to lengths of several centimeters; flat flake or film particles with lengths and widths larger than about 250 microns and up to lengths and widths of several centimeters; and foam particles larger than about 250 microns and up to several centimeters in three dimensions, but of reduced density because of the inclusion of substantial gas voids. They also include intermediate forms between these extremes.

In conventional systems, large and small particles arrive at the workpiece suspended in a gas that is typically filtered, conditioned air. Throughout the remainder of this disclosure, the term "air" will be used in place of the term "gas" with the understanding that gaseous compositions other than everyday breathable air may be used to suspend small solid particles, and are included. In most cases, the gaseous composition will be everyday air that has been filtered to remove particulate contaminants, and conditioned to control temperature and moisture.

The invention is a system for applying coating films and related composite structures formed from large solid precursor particles, or from a combination of large solid precursor particles and small solid precursor particles. The system comprises means for delivering particles of differing size, shape and composition in controlled proportions. The system may optionally include means for imparting an electrostatic charge to the particles.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views.

FIG. 1 is a depiction of a conventional system with an upstream air supply, a hopper spray gun for powder. Air from the air supply 1 is piped into the gun, and directed into a connecting tube 2 leading to the spray nozzle 3 of the gun. A particle entrainment zone 4 is created by providing an opening in the side of the connecting tube, to which is connected a powder-filled hopper 5, such that air and powder from the hopper is drawn at a controlled rate into the passing stream of air. An electrode 6 positioned in the nozzle provides an electrostatic charge to the powder exiting the nozzle.

Figure 2:
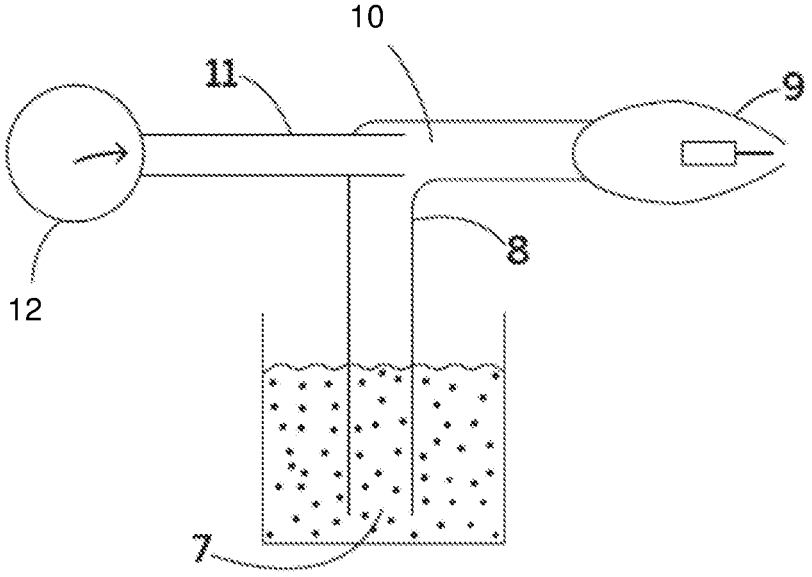
FIG. 2 (Prior Art)

FIG. 2 is a depiction of a conventional system with an in-stream air supply. In this type of system, a particle entrainment zone 7 is provided at the upstream end of the particle feed tube 8, and a spray nozzle/high voltage electrode assembly 9 is connected to the downstream end of the outlet tubing. A flow of high velocity air from the air supply 10 through a small diameter pumping tube 11 operates the venturi pump 12 drawing a flow of air and suspended powder from the particle feed tube 8.

Figure 3:
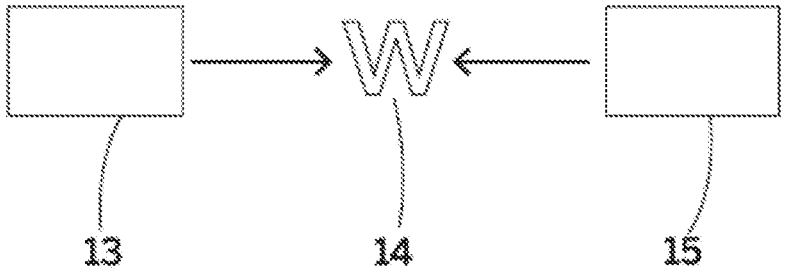
FIG. 3 is a simplified front view schematic of a coating system in accordance with one preferred embodiment of the present application.

FIG. 3 illustrates a system embodying the invention comprised of a subsystem 13 that delivers small particles to the workpiece 14 and a subsystem 15 that delivers a stream of particles at a controlled rate to the workpiece. The subsystems may be operated independently so that the entire system may deliver any ratio of particle types, including only large particles, or only small particles to the workpiece.

Figure 4:
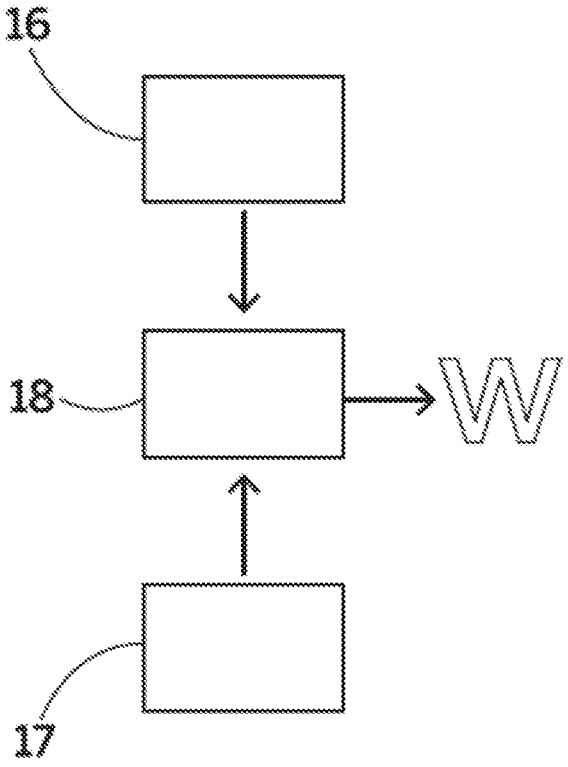
FIGS. 4-6 are simplified front view schematic of the coating system in accordance to an alternative embodiment.

FIG. 4 illustrates a system embodying the invention in which a flow of large 16 and a flow of small particles 17 converge in a system 18 for delivering both types of particles before being directed to the workpiece. The means of each subsystem for controlling the rate of particle flow may be operated independently, so that the entire system may deliver any ratio of particle types, including only large particles, or only small particles to the workpiece.

Figure 5:
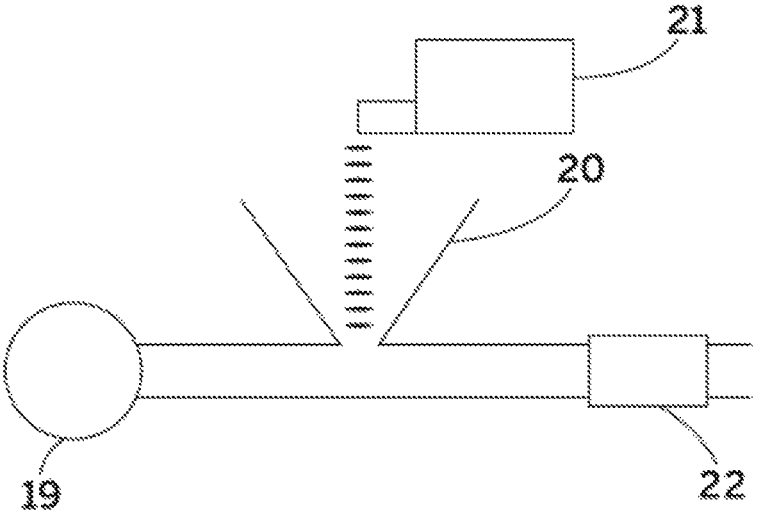

FIG. 5 illustrates a system embodying the invention with an upstream air supply 19, an open hopper 20, and a feeder 21 for controlling the rate of large particle flow. Large particles are delivered through a nozzle 22 with an electrode arrangement that provides a large diameter delivery path for large particles.

Figure 6:
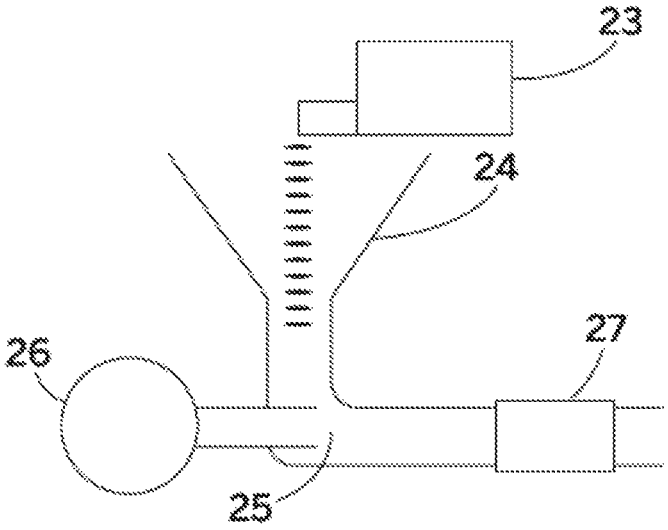

FIG. 6 illustrates a system embodying the invention with a feeder 23 for supplying large particles at a controlled rate, an open hopper 24 at the upstream end of the delivery tube, and an internal venturi pump 25 driven by the air supply 26. Large particles are delivered through a nozzle 27 with an electrode arrangement that provides a large diameter delivery path for large particles.

Figure 7:
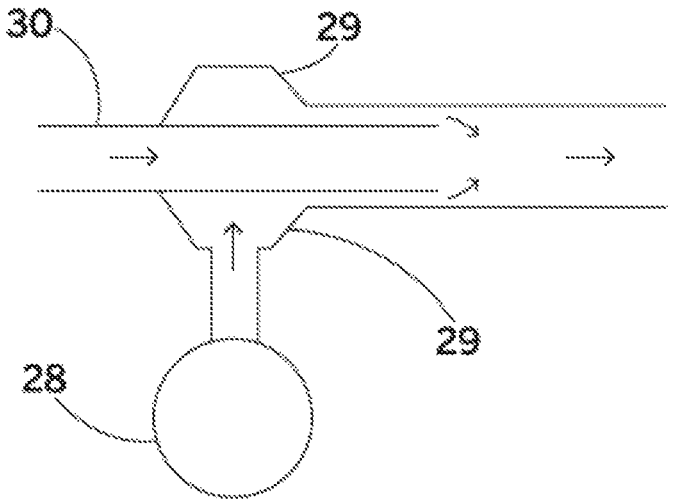
FIG. 7 is a simplified front view schematic of a venturi pump.

FIG. 7 illustrates a venturi pump embodying the invention adapted to pumping suspensions of large particles in air. Air from the air supply 28 passes into a sleeve 29 that extends past the end of the particle inlet tube 30, drawing in a flow of air and suspended particles. The pumped flow of air and particles exits though the delivery tube 31. This arrangement provides improved clearance for large particles and reduces air shear that might damage fragile particles.

Figure 8A:
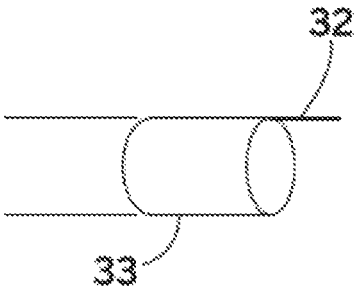
FIGS. 8A and 8B are simplified front view schematics of a spray nozzle utilized with one or more systems of the present application.
Figure 8B:
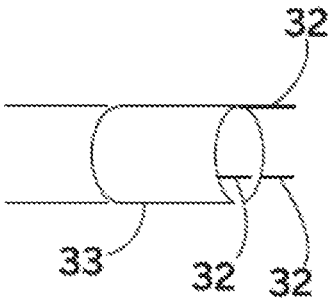

FIG. 8 illustrates an embodiment of the invention, alternative arrangements of high voltage electrodes 32 around the perimeter of spray nozzles 33.

Figure 9:
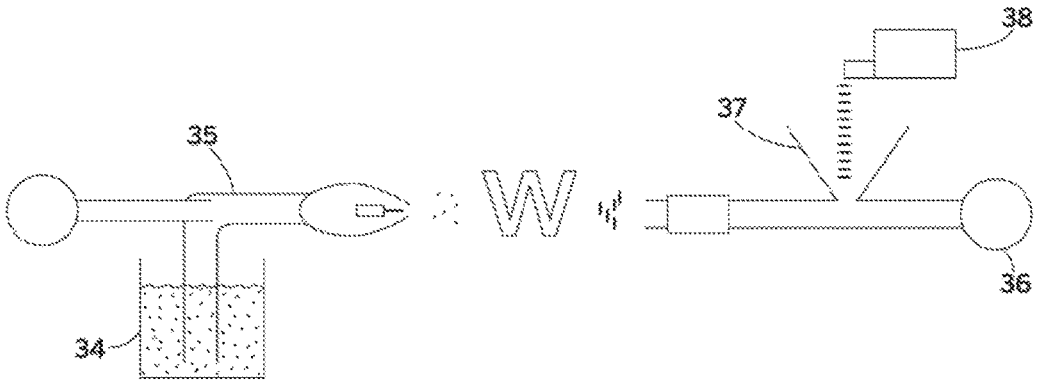
FIG. 9-20 are simplified front view schematics of coating systems in accordance with alternative embodiments of the present application.

FIG. 9 illustrates an example of a system embodying the invention comprised of independent subsystems, one a conventional system for applying small particles to a workpiece comprising a fluid bed 34 and an internal venturi 35 for controlling the small particle delivery rate and the other a conventional system for applying fiber particles to a workpiece comprising an upstream air supply 36 an open hopper 37 and feeder 38 for controlling the large particle delivery rate.

Figure 10:
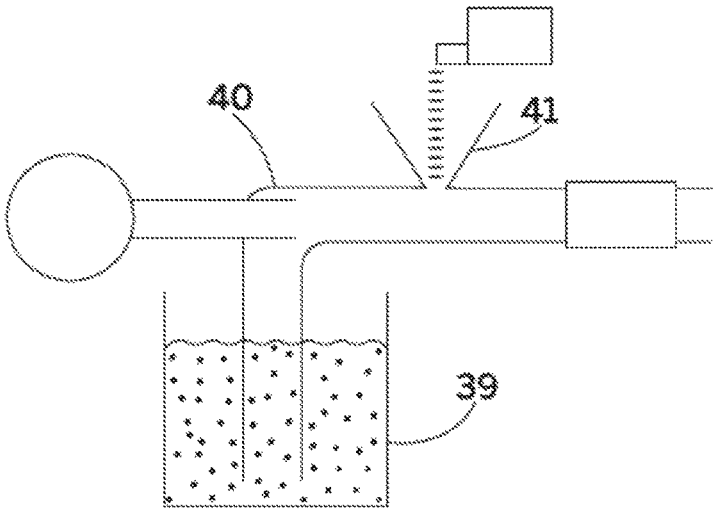

FIG. 10 illustrates a confluent system embodying the invention in which small particles are supplied from a fluid bed 39, air flow is supplied by an internal venturi 40, and large particles are metered in through an open hopper 41 downstream of the venturi.

Figure 11:
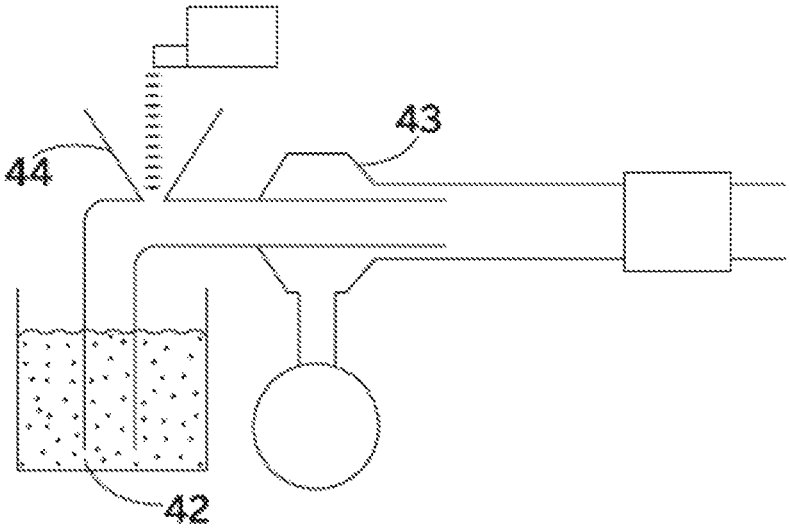

FIG. 11 illustrates a confluent system embodying the invention in which small particles are supplied from a fluid bed 42, air flow is supplied by an external venturi 43, and large particles are metered in through an open hopper 44 upstream of the venturi.

Figure 12:
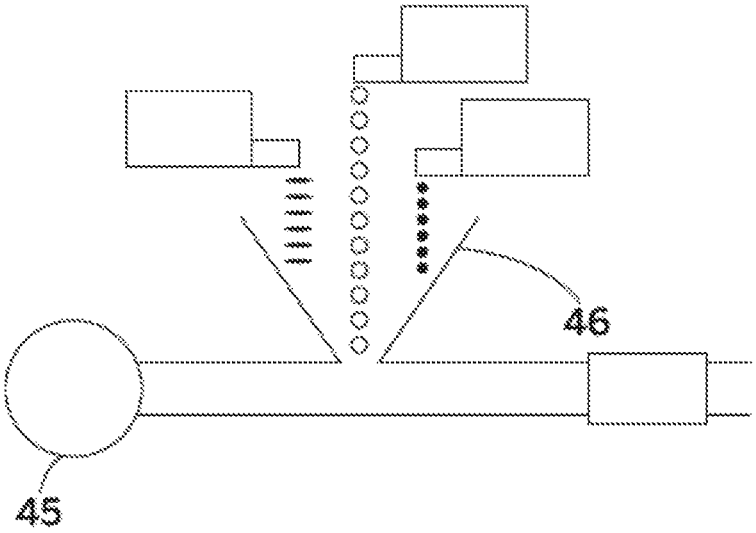

FIG. 12 illustrates a confluent system embodying the invention in which an upstream pump 45 supplies the air flow and three different types of particles are metered in at controlled rates through an open hopper 46.

Figure 13:
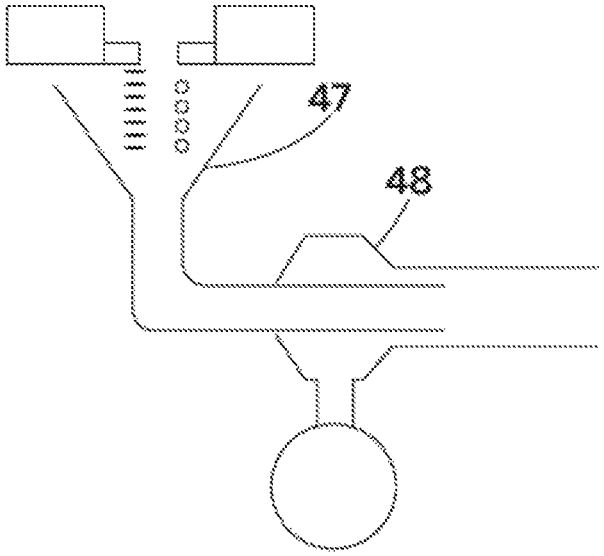

FIG. 13 illustrates a confluent system embodying the invention in which different types of particles are metered in through an upstream open hopper 47 and air flow is supplied by a downstream outer venturi 48.

Figure 14:
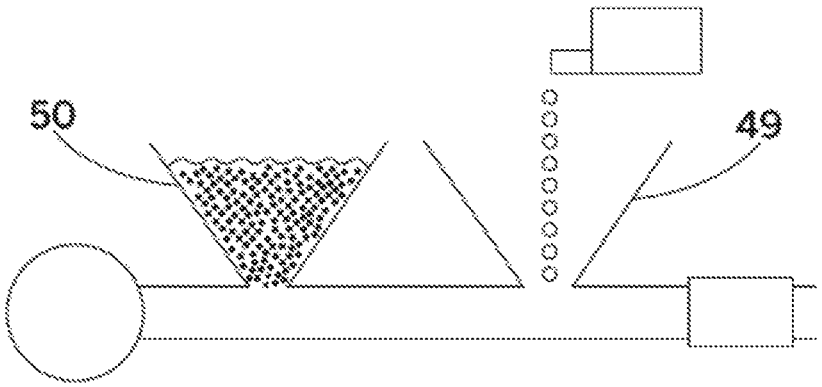

FIG. 14 illustrates a confluent system embodying the invention in which an upstream pump supplies the air flow, large particles are metered in through a downstream open hopper 49 and small particles are supplied though a downstream filled powder feed hopper 50.

Figure 15:
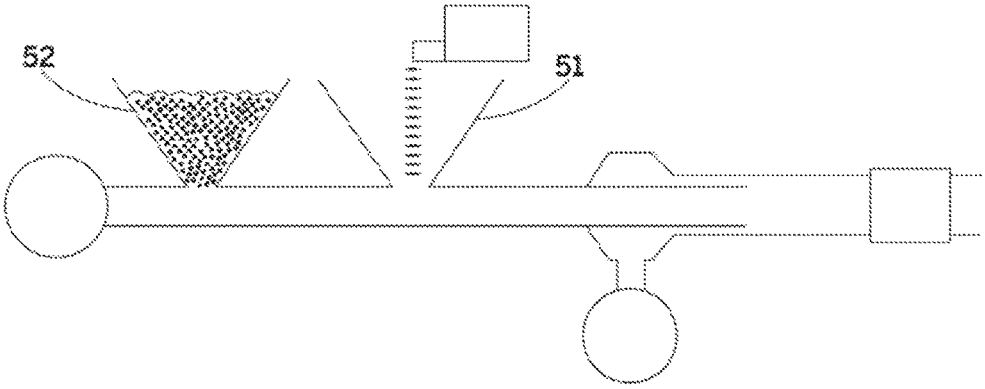

FIG. 15 illustrates a confluent system embodying the invention in which large particles are metered in through a upstream open hopper 51, small particles are supplied though an upstream powder feed hopper 52 and air flow is supplied by a downstream outer venturi.

Figure 16:
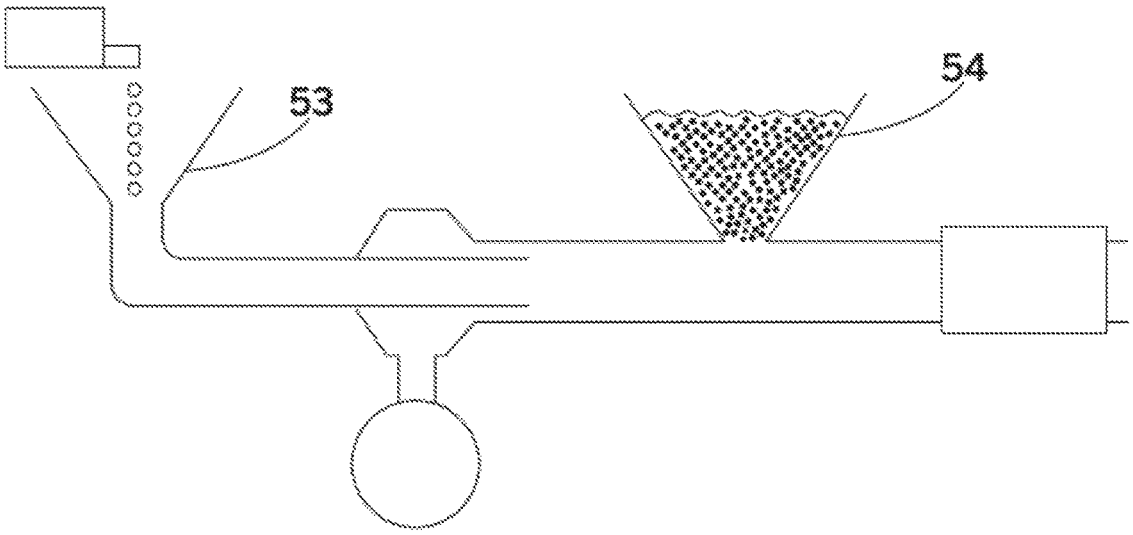

FIG. 16 illustrates a confluent system embodying the invention in which large particles are metered in through a upstream open nozzle 53, air flow is supplied by an outer venturi, and small particles are supplied though a downstream powder feed hopper 54.

Figure 17:
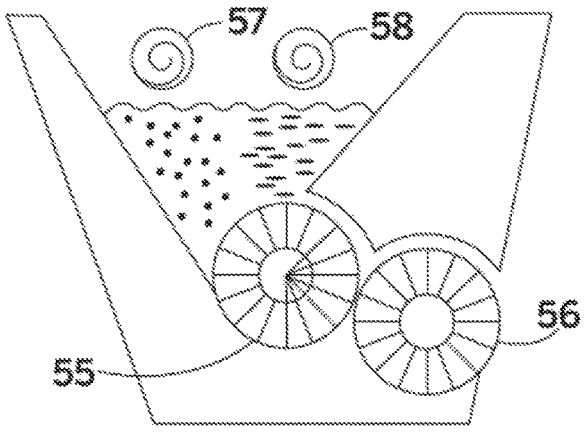

FIG. 17 illustrates a confluent system embodying the invention developed from the hopper and brush assembly of U.S. Pat. No. 5,996,855. In the inventive system a single hopper with a metering brush 55 and an atomizing brush 56 is fed by two feed augurs, 57 and 58, feeding different types of particles at independent rates.

Figure 18:
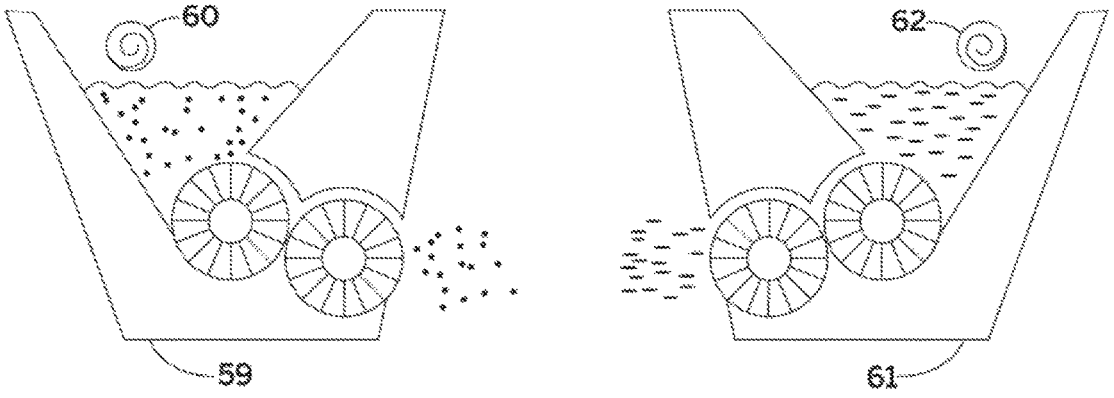

FIG. 18 illustrates a system embodying the invention developed from the hopper and brush assembly of U.S. Pat. No. 5,996,855 comprised of separate subsystems. A first subsystem 59 supplies a cloud of particles through a hopper and brush assembly fed by a feeder 60 at one rate while a second subsystem 61 supplies a second cloud of different particles through a second hopper and brush assembly fed by a second feeder 62 at a second rate.

Figure 19:
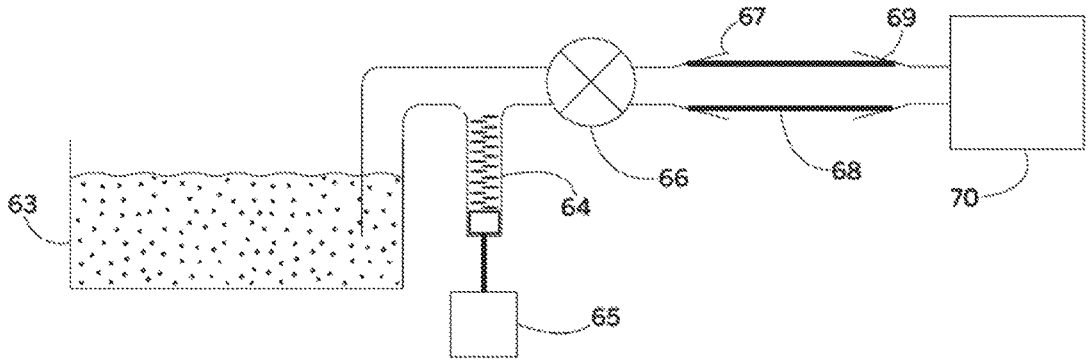

FIG. 19 illustrates a confluent system embodying the invention developed from the system of U.S. Pat. No. 3,982,050 in which a shot of air-fluidized particles is blown through a pre-heated pipe, but adapted to deliver two types of particles. Powder particles are fluidized in fluid bed 63 while large particles reside in a cylinder 64 that can be emptied by a piston driven by a piston driver 65. This upstream part of the system is isolated by a valve 66 from the downstream part of the system which comprises a rotating seal 67, a pre-heated pipe workpiece 68, a second rotating seal 69 and a large evacuated chamber 70. When the valve 66 is opened, air and fluidized powder are drawn into the rotating pipe. At the same time, the cylindrical large particle reservoir is emptied by the piston, adding large particles to the fluidized powder drawn into the rotating pipe.

The invention is a means of applying coating films and related composite structures. It comprises a system that can supply one or more types of large solid precursor particles, including fiber, flake, foam particles, and particles of intermediate form, to a workpiece at controlled rate. A further elaboration of the invention as a means of applying coating films and related composite structures is a system that comprises (a) a subsystem that can supply one or more types of large solid precursor particles, including fiber, flake, foam particles, and particles of intermediate form to a workpiece at a controlled rate, and (b) a second subsystem that can supply small particles at a second controlled rate to the same workpiece.

The system may optionally include means for imparting an electrostatic charge to the small particles, and independently may optionally include means for imparting an electrostatic charge to the large particles.

As above cited, a valuable embodiment of the invention is a method of forming coatings and composite structures having large-scale variations in structure by gas-supported transfer of a particle set that comprises some particles larger than conventional powder coating particles, and may optionally comprise conventional powder coating particles. When forming coatings and composite structures having large-scale variations in structure, it is desirable to be able to control the form and frequency of structural variations. This may be accomplished by controlling the size, shape, and composition of particles from which the coating or composite structure is formed, and by controlling the relative frequency of particle types in the composition. General approaches to controlling the relative frequency of particle types that may be deposited on a workpiece to form a coating or composite structure with large scale variations in structure include: (a) applying previously blended particles, (b) independently applying multiple distinct particle types using separate application systems at controlled rates, (c) applying a blend of distinct particle types using a confluent system, that is, a system in which distinct types of particles are combined at controlled rates by the application system, then applied together.

Method of Blended Particles—

In this embodiment of the invention, the composition of deposited coatings and related composite structures is controlled by preparing blends of the particles that will be applied.

To overcome the tendency of blends of different types of solid particle to segregate in handling, blends should be prepared as close as possible to the point of use in time and space, and handling should be minimized.

Fluid bed systems are especially useful for supplying powder, but they are not generally useful for supplying blends containing large particles of various shapes. Instead, mechanical feeders making use of positive feeding devices such as augurs, belts or rotary vanes should be used. FIG. 5 illustrates the use of a mechanical feeder to supply blended material, including large particles to a spray application system.

A vast number of different types of blend compositions may be applied by such a system. Typical blends of materials that might be supplied by such a system are: Blends of powder and fiber; Blends of powder and flake; Blends of powder and foamed particles; Blends of powder, fiber and flake; Blends of fusible flake and reinforcing fiber.

A desirable composition that may be applied from a prepared blend includes a granite-look composition comprising the following types of particles: White fusible powder, 80%; Gray infusible flakes, 5%; Black infusible flakes, 5%; Red infusible flakes, 2%; Translucent fusible flakes, 8%.

Method of Using Separate Application Subsystems—

In this embodiment of the invention, streams of one or more type of large particles are supplied by independent subsystems, each capable of controlling the rate at which it delivers particles. Small particles may also be supplied by independent subsystems, at controlled rates. Two, three, or more subsystems may be ganged together to supply to the workpiece blends of particles of controlled composition.

Subsystems of the invention for delivering small particles include conventional systems for applying powder coatings at controlled rates, and are included herein by reference. These systems for delivering small particles at controlled rates are well known in the art. Important variants of these systems include: systems that supply powder particles on a stream of air delivered through a powder gun, powder disc, or powder bell; systems that dispense powder into a gas-filled chamber from a hopper by means of a rotating brush; and systems in which a shot of gas-fluidized powder is blown through a pre-heated pipe by application of a high-capacity vacuum at the downstream end.

Systems that Supply Powder Particles Delivered Through a Powder Gun, Powder Disc, or Powder Bell— all these systems that supply powder particles on a stream of air delivered through a powder gun, powder disc, or powder bell are conventionally comprised of the following parts: (a) an entrainment means or zone where the particles become suspended in a flow of air; (b) an air supply to create the flow of air; (c) an outlet nozzle for directing the stream of air and large particles toward a work-piece—said outlet nozzle may optionally comprise a rotating means for dispersing the particle stream; (d) tubing to connect the air supply, the entrainment zone and the nozzle; (e) optionally one or more high voltage electrodes positioned in or near the nozzle to create charged species in the air and on the small particles carried in the air flow. All these conventional systems are incorporated into the invention as subsystems for delivering small particles at controlled rates. These subsystems are used when more than one subsystem is combined, each capable of independently delivering particles at a controlled rate.

Systems that Dispense Powder into a Gas-Filled Chamber from a Hopper by Means of a Rotating Brush—

U.S. Pat. No. 6,875,278 discloses systems for dispersing electrostatically-charged coating powders in a closed chamber to coat steel coils. These systems for delivering small particles at controlled rate are comprised of the following parts: (a) means for delivering powder at a controlled rate to a dispersion hopper, (b) a dispersion hopper with a rotating brush to create a powder cloud (c) a chamber to contain the powder cloud, (d) one or more high voltage electrodes to impart an electrostatic charge to the powder cloud. When a sheet of conductive, grounded substrate, such as a sheet of steel is passed through the chamber, powder from the cloud is deposited thereon. These systems are incorporated into the current invention as subsystems for applying small particles.

Systems in which a Shot of Air-Fluidized Powder is Blown Though a Pre-Heated Pipe—

As disclosed in U.S. Pat. No. 4,698,241 systems in which a shot of gas-fluidized powder is blown through a pre-heated pipe by application of a high-capacity vacuum at the downstream end are conventionally used to apply powder coating to the interior of pipe. Versions are known which deposit a more even film by sequentially introducing a shot of gas-fluidized powder from first one end, then the other end of the pipe. These systems are incorporated into the current invention as subsystems for applying small particles.

Means for Supplying Large Particles at a Controlled Rate—

If provisions are made for the differences in the capacity of air to entrain, support and carry large and of small particles, systems parallel to those used to deliver small particles at controlled rates may be used to deliver large particles as well. These small-particle delivery systems that may be adapted to large-particle delivery include: systems that supply powder particles on a stream of air delivered through a powder gun, powder disc, or powder bell; systems that dispense powder into a gas-filled chamber from a hopper by means of a rotating brush; and systems in which a shot of gas-fluidized powder is blown through a pre-heated pipe by application of a high-capacity vacuum at the downstream end.

Systems that Supply Large Particles Delivered Through a Spray Gun, Disc or Bell—

Systems that supply powder particles on a stream of air delivered through a powder gun, powder disc, or powder bell are conventionally comprised of the following parts: (a) an entrainment means or zone where the particles become suspended in a flow of air; (b) an air supply to create the flow of air; (c) an outlet nozzle for directing the stream of air and large particles toward a work-piece—said outlet nozzle may optionally comprise a rotating means for dispersing the particle stream; (d) tubing to connect the air supply, the entrainment zone and the nozzle; (e) optionally one or more high voltage electrodes positioned in or near the nozzle to create charged species in the air and on the small particles carried in the air flow. In addition to these components, large particle delivery systems need another, (f) a means of supplying large particles at a controlled rate to the entrainment zone.

Means of Supplying Large Particles at a Controlled Rate into the Entrainment Zone—

Several means are known in the art for supplying large particles at controlled rate. Conventionally known as feeders, these machines capture and transfer material by means of screws, belts, vibrating elements, and rotating chambers. Volumetric feeders provide material at flow rates of controlled volume. Gravimetric feeders provide material at flow rates of controlled mass.

Fiber Feeders—

Some feeders are particularly adapted to feeding fibers. Among, these for example, are the chop guns used to chop short lengths of fiber from a roll of roving. Other feeders are adapted to feeding at a controlled rate fiber that has already been chopped. Among these are the rotor and screen assembly disclosed in U.S. Pat. No. 3,551,178, the brush and screen assembly disclosed in U.S. Pat. No. 4,146,177 and the vibrating, perforated bed disclosed in U.S. Pat. No. 4,879,969.

Flake Feeders—

In a manner parallel to the use of a chop gun to cut fiber from a roll of roving, various known devices may be used to break, chop or punch flake particles of controlled size from a fed film material. One particularly useful embodiment breaks flake particles of random size from a film. Another particularly useful embodiment chops uniform flake particles from a film. Another particularly useful embodiment punches flake particles of predetermined shape from a film.

Feeders are available that are adapted to feeding flake particles that have previously been supplied at a controlled rate. Many types of gravimetric and volumetric feeders of widely varying design have conventionally been used for this purpose, and are incorporated into this disclosure as means for providing flake particles at controlled rate.

Foam Feeders—

Foam particles of controlled form and size may be fed by conventional feeders of widely varying design.

Solid foam particles may also be pumped from fluidized beds in much the same manner as powder particles. It is known that a bed of small solid particles ranging in size from about 1 to about 250 microns, and especially between about 10 and 100 microns may be fluidized in a slow flow of air to form a typical dense-phase fluid with volume no more than two or three times that of a non-aerated bed. Large particles may also be conveniently fluidized if they are spheroidal in that all their dimensions, length, width and depth are "similar," and further characterized in that they have ratios of surface area to solid volume like that of small particles.

Particles with "similar" dimensions have no one dimension that is more than about three times the length of any other.

Small particles that may be conveniently fluidized have ratios of surface area to solid volume (excluding any gas bubbles or voids) from about 6.0 for one micron particles to about 0.024 for 250 microns particles. Foam particles larger than 250 microns may also be fluidized if they have ratios of surface area to solid volume ranging from about 0.024 to about 6.0, measured in microns. When fluidized, they may be pumped at controlled rate like fluids, and drawn at controlled rate into orifices such as the openings of pipes, hoses, conduits, ducts and tubing that are held at lower air pressure than the air pressure in the fluid bed. Air flow rate through the orifice determines the rate at which such fluidized particles enter a particle application system.

Particle Entrainment Zone—

Large particles may be supplied into the entrainment zone of systems for supplying large particles such as fibers, flakes and foam at controlled rate by means of various feeders. Devices used conventionally for entraining small particles in air such as filled hopper feed into an entrainment zone of flowing air, fluidizing beds, and air-assisted vacuums may be used for some particles under some conditions, but the most generally useful means for entraining large particles in an air stream is by metering them directly through an open orifice into a flowing stream of air. An especially convenient version of this type of equipment is an open hopper connected to a tube carrying a flow of air. Two versions of the open hopper feeder are particularly useful: side feed, and end feed.

Side-Feed Hoppers—

In the side-feed hopper system, the open-feed hopper is connected to, and directs particles into the side of a tube of flowing air. In this type of system the air supply system is upstream of the side-feed hopper, and particles may pass directly from the hopper into the tube, then though the tube to the outlet nozzle.

End-Feed Hoppers—

In the end-feed hopper system, the open-feed hopper is connected to, and directs particles into the inlet end of a tube of flowing air. In this system, the air supply system, generally a venturi-type pump, is positioned between the two ends of the tube, and particles must pass through the pump on their passage to the outlet nozzle. Venturi pumps adapted to pumping suspensions of large particles in air are disclosed below.

Air Supply System—

Conventional systems for delivering suspensions of large particles in air include at least one air supply system. These conventional systems are typically linked to the overall system by attaching the air supply to the upstream end. Alternatively, the air supply may be linked to a venturi pump connected to the middle of the tubing in a manner analogous to the venturi pumps used in small particle delivery systems. Venturi pumps adapted to pumping suspensions of large particles in air are disclosed below.

Upstream Air Supply—

In systems with an upstream air supply, the air supply is connected by a section of tubing to the delivery nozzle, and an opening is provided in the tubing to provide for ingress of large particles. An especially useful embodiment of this system is open hopper side-feed system described above. In this system, air from an upstream supply flows in a tube. An opening in the side of the tube is provided with an open hopper. Large particles are fed at controlled rate into the open hopper, and enter the air stream in the tube from the side, along with a flow of air.

In-Stream Air Pump, or Venturi Pump—

In systems with an in-stream air supply a venturi pump driven by the air supply is connected to both a feed tube and an outlet tube. Particles enter the feed tube at a rate determined by a metering device through the open end. The air flow, and the particles then pass through a venturi-type pump, and are expelled through a delivery tube to a spray nozzle.

Venturi pumps of conventional design depicted in FIG. 2 and used in systems for delivering small particles may also be used for delivering large particles. However, a preferred design of a pump for a system delivering large particles is the outer venturi-type pump depicted in FIG. 7. In this design the high velocity pumping air is introduced through a tube concentric with the venturi cavity and larger in diameter. This design avoids obstruction of the particle passage, and minimizes particle-damaging shear. Using this venturi design, pumps with very large unobstructed internal passages may be constructed. Both traditional powder coating particles, and most large particles may be conveniently delivered by pumps with internal passages of 20 or 40 millimeters, or even more.

Spray Nozzle—

A spray nozzle may be affixed to the outlet, or downstream end of systems for delivering suspensions of large particles in air. Nozzles of various shapes have been developed to shape the exiting particle/gas suspension for powder coating systems, and these nozzles may also be used for delivering suspensions of large particles in air. Rotating means may be added to distribute powder particles. In preferred embodiments, clearances for the passage of the suspension of particles in air are at least six mm, preferably at least twelve mm, and more preferably 20 mm or 40 mm or more. One or more high voltage electrodes are commonly placed inside or adjacent to the nozzle.

High Voltage Electrode—

One or more electrodes charged to a potential of between about 20,000 and about 130,000 volts may be positioned inside or adjacent to the nozzle as known in the art for systems that supply small particles suspended in air. These electrodes may be positioned inside the nozzle, as in many powder coating system designs, but are preferably placed at the edges of the air stream so that they do not restrict the size of particles the system can deliver.

Tubing—

Tubing of between about 9 and 12 mm (about ⅜ to ½-inch) in diameter as used in small particle application systems may be useful in certain cases with certain large particles. Preferably the tubing is larger than 12 mm, and may be 20 mm, or 40 mm or larger. To minimize problems such as clogging of the tube, the deposition of impact-fused particles, and breakage of particles, the tubing should be laid out with a minimum of curves. Curve radii should be at least equal to the diameter of the tubing, preferably at least three times the diameter of the tubing, or more.

Systems that Dispense Large Particles into a Gas-Filled Chamber from a Hopper by Means of a Rotating Brush—

Systems like that disclosed in U.S. Pat. No. 6,875,278 to dispense small particles into a gas-filled chamber from a hopper by means of a rotating brush may also be adapted for dispensing large particles into a gas-filled chamber at a controlled rate, and for delivering large particles to a workpiece in the gas-filled chamber. When adapted to the delivery of large particles, such systems comprise the following parts: (a) means for delivering large particles at a controlled rate to a dispersion hopper, (b) a dispersion hopper with a rotating brush to create a powder cloud (c) a chamber to contain the powder cloud, (d) one or more high voltage electrodes to impart an electrostatic charge to the powder cloud.

Means for Delivering Large Particles at a Controlled Rate to the Dispersion Hopper—

Several means are known in the art for supplying large particles at controlled rate. Conventionally known as feeders, these machines capture and transfer material by means of screws, belts, vibrating elements, and rotating elements. Volumetric feeders provide material at flow rates of controlled volume. Gravimetric feeders provide material at flow rates of controlled mass. Some feeders may feed all types of large particles. Others are more particularly adapted to feeding fiber, flakes, or foam particles. All of these types of feeders may be used to supply large particles at controlled rates to a dispersion hopper. Preferred feeders for this application include the augur feeder disclosed in U.S. Pat. No. 5,996,855, and the rotating brush feeder disclosed in U.S. Pat. No. 6,875,278, and included herein by reference.

When a sheet of conductive, grounded substrate, such as a sheet of steel is passed through the chamber, large particles are deposited thereon. These systems are incorporated into the current invention as subsystems for applying large particles.

Systems in which a Shot of Air-Fluidized Large Particles is Blown Though a Pre-Heated Pipe—

As disclosed in U.S. Pat. No. 4,698,241 systems in which a shot of gas-fluidized powder is blown through a pre-heated pipe by application of a high-capacity vacuum at the downstream end are conventionally used to apply powder coating to the interior of pipe. Versions are known which deposit a more even film by sequentially introducing a shot of gas-fluidized powder from first one end, then the other end of the pipe. This type of system may also be adapted to applying large particles.

In one particularly useful variant, large particles are applied that contain both fusible matrix forming materials, and fibrous reinforcing materials.

In one particularly useful variant, large particles are applied that contain both fusible matrix forming materials and barrier-forming flake materials.

Method of Applying Confluent Particle Streams

In this embodiment of the invention, particle delivery systems are combined so that different types of particles are delivered to the workpiece as a single blended stream. Different particle types are fed at controlled rates into a combined application system.

An embodiment of confluent systems is depicted in FIG. 10. This embodiment can be understood as a standard powder spray gun to which a means has been added for introducing a second type of particle to the air/powder stream. An air supply connected to an internal venturi creates the air flow in the delivery tube. At the upstream end of the tube is positioned a powder fluid bed 39. A combination of air and powder particles is drawn into the delivery tube at a rate controlled by the flow of air in the venturi. Downstream of the venturi, an opening is provided in the side of the delivery tube. An open hopper 41 is affixed to this opening, and a second type of particle, for example large and/or fragile particles such as fiber, flake or foam particles is fed into this open hopper at a controlled rate. These particles are drawn through the bottom of the hopper into the delivery tube to blend with the passing air/powder stream. The combined stream passes out though the spray nozzle. If desired, the stream of particles may be electrostatically charged by operating the high voltage electrode.

A related embodiment of the confluent spray invention is depicted in FIG. 11. In this embodiment a venturi is again provided to produce an air flow in the delivery tube, and a fluid bed is provided at the upstream end to produce a controlled flow of powder particles. An open hopper with an associated feeder is also provided, but it has been moved upstream of the venturi. To enable the delivery of large and/or fragile particles such as fiber, flake or foam particles, an outer venturi 43 of the invention is used.

Another embodiment of the confluent spray invention is depicted in FIG. 12. In this embodiment an air supply is connected to the upstream end of the delivery tube, and a single open hopper 46 is provided in the side of the delivery tube. Two, three, or more feeders are positioned above the open hopper such that each delivers a stream of particles at a controlled rate. The particles are drawn through the orifice at the bottom of the hopper into the passing air stream in the delivery tube, and carried to the spray nozzle, and sprayed toward a workpiece, with optional electrostatic charging.

A related embodiment of the confluent spray invention is depicted in FIG. 13. In this embodiment, an open hopper 47 is supplied at the upstream end of the delivery tube. Two, three, or more feeders are positioned above the open hopper such that each delivers a stream of particles at a controlled rate, and a venturi is used to create the air flow in the delivery tube. To enable the delivery of large and/or fragile particles such as fiber, flake or foam particles, an outer venturi 48 of the invention is used.

Another embodiment of the confluent spray invention is depicted in FIG. 14. In this embodiment an air supply is connected to the upstream end of the delivery tube, and two, three, or more hoppers are provided in the side of the delivery tube. These hopper may be designed to operate full of particles 50, as is typically done with powder coatings, or to operate open 49, as may be done with large particles. Particles drawn through the orifices at the bottom of the hoppers join the passing air stream in the delivery tube, are carried to the spray nozzle, and are sprayed toward a workpiece, with optional electrostatic charging.

Another embodiment of the confluent spray invention is depicted in FIG. 15. In this embodiment two, three, or more hoppers are affixed to the delivery tube upstream of a venturi air pump. These hopper may be designed to operate open 51 as may be done with large particles, or to operate full of particles 52, as is typically done with powder coatings. Particles drawn through the orifices at the bottom of the hoppers join the air stream in the delivery tube, are carried through the venturi pump and through the delivery tube to the spray nozzle, where they are sprayed toward a workpiece, with optional electrostatic charging. To enable the delivery of large and/or fragile particles such as fiber, flake or foam particles, an outer venturi of the invention is used. In this embodiment, a second air supply is connected at the upstream end to allow more options in the air flow through the system.

Another embodiment of the confluent spray invention is depicted in FIG. 16. In this embodiment two, three, or more hoppers are affixed to the delivery tube, with at least one upstream and at least one downstream of the venturi pump.

Another embodiment of the invention for delivering a confluent stream of more than one type of particle, an embodiment especially adapted to delivering both large and small particles is depicted in FIG. 17. In this embodiment two or more feeders 57 and 58 supply particles at controlled rates into the hopper for dispersion, forming a defined mixture of particles. This mixture is metered by the metering brush 55 and expelled from the hopper in a cloud by the atomizing brush 56. A variety of feeders may be used to deliver the different streams of particles. Preferred feeders for this application include the augur feeder disclosed in U.S. Pat. No. 5,996,855, and the rotating brush feeder disclosed in U.S. Pat. No. 6,875,278, and included herein by reference.

Another embodiment of the invention for delivering a confluent stream of more than one type of particle is depicted in FIG. 19. Powder particles are fluidized in fluid bed 63 while additional types of particles, such as fiber or flake particles reside in one or more cylinders 64 that can be emptied by pistons driven by piston drivers 65. This upstream part of the system is isolated by a valve 66 from the downstream part of the system which comprises a rotating seal 67, a pre-heated pipe workpiece 68, a second rotating seal 69 and a large evacuated chamber 70. When the valve 66 is opened, air and fluidized powder are drawn into the rotating pipe. At the same time, the large particle reservoir is emptied by the piston, adding large particles to the fluidized powder drawn into the rotating pipe. Although a piston is depicted in the figure, other means for rapidly delivering a substantial volume of particles at a controlled rate may be used, such as augur feeders. The positioning of the piston feeder is depicted below the particle delivery tube for convenience. Piston feeders and other feeders may be operated in other orientations, for example, feeding horizontally into the delivery tube, or down into the delivery tube. In another version, no fluid bed is provided, and all the particles are delivered by feeders such as pistons or augurs.

Versions of this system are known which deposit a more even film by sequentially introducing a shot of gas-fluidized powder from first one end, then the other end of the pipe. This type of system may also be adapted to applying controlled combinations of particles by adding feeders such as piston or augur feeders.

In one particularly useful variant, mixtures of particles are applied that contain both fusible matrix forming materials, and fibrous reinforcing materials.

In one particularly useful variant, mixtures of particles are applied that contain both fusible matrix forming materials and barrier-forming flake materials.

Examples of Coatings and Composite Structures with Large-Scale Variations in Structure that May be Produced from Particle Sets Containing Large Solid Particles and Optionally Conventional Powder Coating Particles:

Fiber-modified films and structures: Strengthened by strong fibers; Stiffened by stiff fibers; Toughened by flexible fibers; Rendered electrically conductive by conductive fibers; Consolidated films with few voids; Net-like films with many voids.

Films and structures with mechanical property modifications from flake particles: Rendered impermeable by impermeable flakes; Rendered abrasion-resistant by abrasion resistant flakes; Toughened, strengthened or stiffened by polymer flakes; Toughened, strengthened or stiffened by fiber-containing flakes: Unidirectional fibers; Woven fibers; Non-woven multidirectional fibers.

Films and structures with decorative modifications from flake particles: With large areas of two or more colors; With decorative devices, such as spades, hearts, goldfish, numbers, letters, etc.; With logos, or other identifying marks; With high reflectivity from metalized particles.

Films and structures with structural modifications from foam particles; With high void content; With high void content containing fibers; With high void content, but consolidated skins; With high void content, but consolidated skins containing fibers.

Films and structures with decorative modifications from foam particles: With large areas of two or more distinct colors; With large-scale topography such as lumps, bumps and ridges.

Films and structures comprising combinations of two- or more types of large particles: Flakes of different compositions; Fibers of different compositions; Foams of different compositions; Compositions comprising two or more of fibers, flakes and foam; and Compositions comprising fibers, flakes and foam.

Examples of Coatings and Composite Structures with Large-Scale Variations in Structure Fiber Reinforced Coating:

A spray application is set up in which one or more conventional powder delivery devices, powder "guns" or "bells" delivers electrostatically-charged powder, and a chopped strand spray gun delivers electrostatically-charged glass fiber such as a chopped strand glass with individual fibers between 4 and 10 mm in length and 4-20 microns in diameter. The powder and glass aerosols are directed toward and deposited on a grounded part with a conductive surface. The coated part is subsequently heated to melt the fusible powder and incorporate the glass fibers, producing an article coated with a glass-reinforced film.

Fiber Reinforced Coating:

In a spray application such as the Fiber Reinforced Coating example, electrostatic charging of the conventional coating powder and the glass is accomplished not in the spray delivery device, but by independent high voltage electrodes in the application chamber, such as a charged wires.

Fiber-Reinforced Structure—

A composition comprising from 1 to 50% reinforcing fiber and from 50-99% thermosetting powder coating is applied by electrostatic spray to an electrically grounded conductive workpiece. Upon heating, the powder melts and cures, and the composition coalesces into a fiber-reinforced coating or composite structure.

Fiber-Reinforced Structure—

A composition comprising from 1 to 50% reinforcing fiber and from 50-99% thermosetting powder coating is applied to a pre-heated workpiece. The powder melts as the composition accumulates and the composition coalesces, curing into a fiber-reinforced coating or composite structure. The particle application may optionally be done using electrostatic spray equipment, and the workpiece may be grounded and conductive.

In a preferred embodiment, a composition comprising reinforcing fiber particles and thermosetting powder particles is applied by electrostatic spray to the exterior of a rotating, grounded metal pipe that has been preheated so that the powder melts as it is applied. The composition coalesces to a film, and cures, producing a fiber-reinforced coating of improved resistance to damage on the pipe.

In a preferred embodiment, a composition comprising reinforcing fiber particles and thermosetting powder particles is applied by electrostatic spray to steel rods such as reinforcing rods intended for use in concrete that have been preheated so that the powder melts as it is applied. The composition coalesces to a film, and cures, producing a fiber-reinforced coating of improved resistance to damage on the steel rods.

In a preferred embodiment, the outermost layer of coating comprises more fiber particles than are completely encapsulated or embedded in the reinforcing matrix, such that a surface layer of partially embedded fibers is produced on the bar.

Loose Fiber-Reinforced Structure—

A composition comprising from 50-90% reinforcing fiber and from 10-50% thermosetting powder coating is applied to a preheated workpiece. The powder melts as the composition accumulates and the composition coalesces, curing into a fiber-reinforced coating or composite structure containing a large fraction of voids. The composition may optionally be applied by electrostatic spray and the workpiece may be electrically grounded and conductive.

Fabric-Reinforced Structure—

A composition comprising from 1-50% fabric particles and from 50-99% thermosetting powder coating is applied to a workpiece. Upon heating the powder melts and the composition coalesces to form a fabric-reinforced coating or structure. The composition may optionally be applied by electrostatic spray to a conductive workpiece. The workpiece may optionally be pre-heated. The fabric particles may be comprised largely of unidirectional fibers, may be comprised of randomly oriented fibers, or may be woven or knitted.

Fabric-Reinforced Structure—

A composition comprising from 50-90% fabric particles and from 10-50% thermosetting powder coating is applied to a workpiece. Upon heating the powder melts and the composition coalesces to form a fabric-reinforced coating or structure containing a large fraction of voids. The composition may optionally be applied by electrostatic spray to a conductive workpiece. The workpiece may optionally be pre-heated. The fabric particles may be comprised largely of unidirectional fibers, may be comprised of randomly oriented fibers, or may be woven or knitted. The fabric particles may be essentially flat, or may be space-filling, such as a loose ball of fibers.

Fiber-Reinforced Structure—

Previously-formed flake particles comprised of fiber and a thermosettable matrix are applied to a workpiece. Upon heating, the matrix melts, coalescing the flake particles into a fiber-reinforced film that cures into a fiber-reinforced coating or structure.

Skinned Composite Structure—

This example illustrates that complex structures may be prepared by varying over time the composition of a blend of particles applied to a workpiece. A pre-heated mold with a layer of mold-release agent on its surface is first provided. A series of different compositions are applied to the mold:

Aluminum flake particles, previously coated on both sides with a clear thermosetting composition;

A composition comprising 1-50% reinforcing fiber and 50-99% thermosetting powder coating;

A composition comprising 50-90% reinforcing fiber and 10-50% thermosetting powder coating;

A composition comprising 1-50% reinforcing fiber and 50-99% thermosetting powder coating;

A thermosetting powder coating.

After curing and cool-down, a low density, fiber reinforced structure with a reflective metallic surface is released from the mold. In a similar manner, a wide variety of structures may be prepared from combinations of powder coatings, fiber particles, flake particles and foam particles.

Application of Large Flake Particles to Form a Decorative Film.—

50 grams of red-colored flake particles are combined with 950 grams of a clear powder coating in a fluid bed. Using a large bore spray gun with tubes, hoses, and internal gas passages of >12 mm, the fluidized blend of powder coating and red flake particles are applied to white-primed metal panels. The panels are baked 10 minutes at 175° C. to produce a glossy white surface decorated with red shapes.

Preparation of a Highly-Reflective Film—

Reflective, hexagonal, large flake particles are applied to a grounded steel chair base applied using a large bore spray gun with tubes, hoses, and internal gas passages of >12 mm. The particle-coated chair base is then baked at 175° C. for 15 minutes to melt the coating on the metalized particles, and coalesce them into a smooth film with reflectivity greater than 90%.

Reinforced Film from Flake Particles—

Fabric-reinforced flake particles are applied using a large bore spray gun with tubes, hoses, and internal gas passages of >12 mm, to a pre-heated part. The coating on the fabric melts and coalesces the particles into a film, which cross-links, or cures, to a fabric-reinforced film.

Fabric-reinforced flake particles of low electrical conductivity may be applied to a grounded, room temperature part. Heating of the part in an oven in a conventional manner melts the applied coating and produces a reinforced coating film.

Multicolored Coatings or Composites—

A composition comprising particles of two or more distinct colors is applied to a workpiece and heated to form a multicolored film, with the following provisions: At least one of the colored particle types must comprise flake particles of the invention, and be present in visible quantities; and enough of the particles must melt or soften when the composition is heated to allow it to coalesce into a coating—typically at least 10% of the mass must soften, and preferably 50% or more.

It will be appreciated that particles of a distinct color may comprise a very small weight fraction of a composition, much less than 1%, and still be visible. It will also be appreciated that large and small particles of three, or four or many colors may be combined to produce a wide variety of coating colors and effects. The composition may optionally be applied by electrostatic spray and the workpiece grounded and electrically conductive. The workpiece may optionally be pre-heated.

In a preferred embodiment metal articles intended for use on buildings, for example office buildings, are coated with a combination of powder particles and flake particles. Upon heating, the composition coalesces to a coating that imitates natural stone such as granite or marble.

Coatings with Particles of Designed Shapes—

In a special case of the multicolored coatings or composites, one of the particle types of the composition comprises flake particles of specific designed shape. An example of a non-specific designed shape is flake particles of random shape produced when a brittle sheet is broken into particles that will fit through a ¼" mesh. Specific designed shapes, in contrast, include, for example: shapes as circles, ovals, triangles, squares or other named polygons that may be cut from paper, glass, polymer, or other solid film. Specific designed shapes also include symbols such as stars, four-leaf clovers, hearts, lightning bolts, etc.; stylized fish, dogs or other animals, or people; words, logos and trademarks; printed representations, such as identifiable individual people, text, and pictures of real or imaginary items.

The inventive concept of including specific designed shapes in coating compositions formed by spraying solid particles opens an infinite range of decorative possibilities, so many that examples cannot illustrate its breadth. Nevertheless, it is useful to define certain extreme cases.

In a preferred embodiment a composition comprising a large fraction of particles of a single color is applied to a metal article, and then a small fraction of a specific designed shapes is applied. The composition is cured to provide a film of uniform appearance with dispersed specific designed shapes, for example, red polka dots sprinkled on a white-painted bicycle, or batch markers on a length of coated pipe.

In a preferred embodiment the small fraction of specific designed shapes comprise marks, logos, or slogans identifying entities associated with the item, such as the manufacturer, seller, purchaser, user, or sponsor. For example, an in-mold coating applied to a ski helmet might feature random signatures of the reigning world downhill racer, or a cosmetic case might feature the imprint of Marilyn Monroe's lips.

In a preferred embodiment, a composition comprising a large fraction of a specific designed shape is applied. The composition is cured to provide a film of variegated appearance, for example, a collage of overlapping flowers on a computer case, or an overlapping pattern of stones camouflaging an armored personnel carrier.

Coatings or Structures with Large Areas of Different Colors—

A composition comprising fusible foam particles of a first color and other fusible particles of a second color is applied to a workpiece. Upon heating, foam particles of the first color melt, the bubbles coalesce, the gas escapes, and the resultant void-free liquid spreads on the workpiece surface to create a large area of the first color. Similarly, foam particles of the second color melt to create large areas of the second color. In this manner a coating is formed with large-scale variations in color. By this method, foam particles of many colors may be applied to create coatings of many colors with large-scale color variations. Particles may optionally be applied by electrostatic spray to a grounded workpiece. The workpiece may optionally be pre-heated.

In a preferred embodiment, a composition comprising foam particles of two, three or more distinct colors is applied using a cloud chamber to a grounded, preheated sheet of steel. The foam particles melt and flow out to form a coating film displaying large areas of two, three, or more distinct colors.

Coatings or Structures with Textured Surfaces—

A composition comprising fusible foam particles is applied to a workpiece. Upon heating, the foam particles soften and coalesce, but because of restricted flow, form a film with a lumpy, textured surface.

Foam-Containing Composite Structures—

This example illustrates that complex structures may be prepared by varying over time the composition of a blend of particles applied to a workpiece. A pre-heated mold with a layer of mold-release agent on its surface is first provided. A series of different compositions are sequentially applied to the mold: Powder coating particles of a weather-resistant composition are first applied; a composition comprising approximately equal amounts of foam particles that melt and coalesce without degassing and fiber particles that have been coated with a fusible surface layer are applied together, and then fusible flake particles of a tough, impact-resistant composition are applied.

After all the compositions are applied, the mold containing the composition is heated to complete the cure of the composite structure. After curing and cool-down, a void-filled, fiber-reinforced structure with one weather-resistant surface and one mechanically-toughened surface is released from the mold.

Preparation of Large Particles of the Invention—

Fiber Particles

Fiber particles of the invention have two physical dimensions that are similar to those of conventional of powder coatings known in the art. These may be thought of as width and thickness, or as circular diameter. The diameter of these particles may be, for example, from about 1 to about 250 microns. The third dimension of these particles, length, may range from about 250 microns to much longer, for example 300 microns, or two millimeters, or one centimeter, or two centimeters, or more.

The cross section of the fiber particles may be regular, such as circular, ellliptical, square, rectangular or star-shaped, etc, or may be irregular.

Number—

Fiber particles may comprise a single fiber, or may also comprise assemblies of two, or a dozen, or a hundred individual fibers, or 12,000 or 50,000 or more fibers as provided in conventional roving bundles.

Coatings—

Individual fiber particles of the invention may comprise fibers or fiber bundles that are uncoated, or they may be coated with one or more fusible or infusible layers of non-fibrous matrix material, or of combinations of fusible and infusible layers, or coated with fusible, curable compositions. Fibers may be individually coated, or coated as a group.

Curable compositions may comprise, but are not limited to the following general binder types commonly used in powder coatings: epoxy, epoxy-polyester hybrid, triglycidyl isocyanurate-cured polyester, hydroxyalkylamide-cured polyesters, isocyanate-cured polyesters, acid-functional acrylics, hydroxyl-functional acrylics, epoxy-functional acrylics, silicone-based compositions, ultraviolet-light-curable compositions, free radical-curable compositions, and fluorocarbons.

Composition

Fibers in fiber particles may be prepared from many materials, including, but not limited to: metals such as aluminum, stainless steel and nickel; inorganic oxide glasses such as E glass and S glass; carbon, man-made organic polymers, such as: polyolefins such as polyethylene and polypropylene, polyesters such as polyethylene terephthalate and polybutylene terephthalate, polyamides such as Nylon 6,6, Nylon 6, Nylon 11, Nylon 12; polyaramides such as Kevlar, cellulosics such as Rayon and cellulose acetate; natural fibers such as wood, Jute, Kenaf, Hemp, Linen, Cotton, Silk and wool. Fibers may be clear or opaque, pigmented or naturally colored.

Thermal Behavior—

Fibers may be formed from materials that undergo one or more changes such as softening, melting, or crosslinking at the time the assemblage of particles is melted to form a coating film, or may undergo no change.

Separate, Non-Bonded Fibers—

Fiber particles embodying the invention are commercially available as monofilaments, as non-bonded fiber bundles, and as fiber bundles bonded together into tow. In a preferred embodiment the fibers are not glued or bonded to one another, but may move separately.

Discrete Length—

In order that they may be applied to workpieces by gas-supported transfer, fibers of the invention may be of discrete length between 250 microns and several centimeters. In one embodiment, fibers that have been chopped to appropriate discrete length to be applied by equipment of the invention may be used. In another embodiment, longer fibers, such as rolls of continuous fiber are used, and are chopped to desired length by the particle application system.

Non-Conductive Surfaces—

Fiber particles embodying the invention may be formed from essentially any material that may be formed into fiber shape. In a preferred embodiment, fiber particles intended for electrostatic application to workpieces that are not preheated have non-conductive surfaces.

Coated Fiber by Powder Application—

Continuous fiber is heated and passed through a cloud of fusible coating powder, where it accumulates a layer of melted coating material. The coated fiber is subsequently passed out of the coating chamber, and cooled to solidify the coating melt. The fiber is then chopped to convenient lengths between about 250 microns and several centimeters to provide coated fiber particles of the invention. The formed coating may optionally be both fusible and curable (or cross-linkable).

Preparing Coated Fiber Particles—

Continuous glass fiber or continuous fiber bundles are heated to between 100 and 200° C. and passed through a coating powder cloud, where they accumulate a layer of melted coating material. The coated fiber or coated fiber bundles is subsequently passed out of the coating chamber, and cooled to solidify the coating melt. The fiber or fiber bundles are then chopped to convenient lengths between about 4 mm and several centimeters to provide coated fiber particles.

Coated Fiber by Liquid Application—

Continuous fiber is passed through a liquid application system to provide a liquid layer of coating on the fiber. This liquid layer is solidified by one of the many conventional processes, such as solvent evaporation, cooling, or polymerization to form a layer of solid coating on the fiber. The coated fiber is then chopped to convenient lengths between about 250 microns and several centimeters to provide coated fiber particles of the invention. The formed coating may optionally be both fusible and curable (or cross-linkable).

Coated Carbon Fiber Particles—

Continuous carbon fiber or fiber bundles are passed through a liquid application system to provide a liquid layer of coating binder precursor on the fiber. This liquid layer is solidified by one of the many conventional processes, such as solvent evaporation, cooling, or partial polymerization. The fiber or fiber bundles are then chopped to convenient lengths, between about 4 and about 20 mm to provide coated carbon fiber particles In a manner analogous to the preparation of coated carbon fiber particles, continuous fibers or fiber bundles of many different compositions are coated, for example natural fibers such as cotton, flax, hemp, jute, silk and wool, and man-made fibers such as rayon, polyester, acrylic, polypropylene, polyethylene, polyamide and polyaramide, or mixtures of natural fibers, or mixtures of man-made fibers, or mixtures of natural and man-made fibers.

The fiber or fiber bundles are then chopped to convenient lengths between about 4 mm and several centimeters to provide coated fiber particles.

Flake Particles

These particles of the invention have one physical dimension that is similar to that of conventional powder coatings, for example thickness from 1 to 250 microns, and two dimensions that are larger. These other two dimensions may be described in various ways, for example as length and width, or as circular diameter. In a flake particles of the invention these other two dimensions are larger than a conventional coating particle, that is, greater than 250 microns, for example 300 microns, or two millimeters, or one centimeter or two centimeters, or more.

Multiple Layers, Materials and Thermal Behaviors—

Flake particles may be formed from one layer or from multiple layers of the same or different materials. Layers may be flexible or ridged. Individual layers may undergo one or more changes such as softening, melting, or cross-linking at the time the assemblage of particles is melted to form a film, or may undergo no change.

Composition—

The materials from which flake particles may be composed include, but are not limited to glass, metal, mica, paper, natural and man-made polymers and glass. These particles may be prepared from a single material, or blends of materials, including fully-formulated, curable systems such as are conventionally used to form coatings powders.

Curable compositions may comprise, but are not limited to the following general binder types commonly used in powder coatings: epoxy, epoxy-polyester hybrid, triglycidyl isocyanurate-cured polyester, hydroxyalkylamide-cured polyesters, urethane-cured polyesters, acid-functional acrylics, hydroxyl-functional acrylics, epoxy-functional acrylics, ultraviolet-light-curable compositions, free radical-curable compositions, silicones, and fluorocarbons.

Flake particles may contain one or more types of fibers. Fibers may be unidirectional, may be randomly oriented, may be oriented in patterns, and may be woven.

Appearance—

In visual aspect flake particles may be variously clear, opaque, pigmented, patterned, printed, or reflective, or combinations of these attributes. The surface may be high gloss, mid gloss, satin, low gloss, flat, textured, or oxidized, or combinations of these.

Thermal Behavior—

At the time an assemblage of particles is heated to form a film, flake particles may exhibit a variety of thermal behaviors, including, but not limited to: non-softening, conformable softening, melting, shrinking, expansion, and crosslinking or curing.

Flake particles, with or without fusible polymer coatings, may be applied in combination with conventional powder coatings or with other large particles.

In a preferred embodiment, flake particles contain on their large faces fusible, curable compositions that may coalesce with other particles to form cured films.

In a preferred embodiment, a flake particle comprises an inner layer of highly reflective material, and two outer layers of clear, fusible, curable polymer.

In a preferred embodiment, a flake article comprises an inner layer of, opaque, pigmented material, and two outer layers of clear, fusible curable polymer.

Within the limits of the flake form, particles may be random in shape, or they may have any one of a variety of non-random shapes, including, but not limited to: squares, rectangles, diamonds, truncated squares, regular polygons with 3, 4, 5, 6, 7, 8 or mores sides, circles, ovals, star-shapes, heart-shapes, shapes like a club or a spade, shapes like animals, birds, fish, people or any of the myriad shapes into which flake-form or sheet-form materials may be cut, stamped, or formed.

Preparation of Large Particles of the Invention—Flake Particles

Commercial Sources—

Flake particles of the invention of various composition may be purchased pre-formed. Examples include are metal flakes, glass flakes, polymer flakes, and fabric flakes.

Chopping of Films—

A wide variety of materials are available as films that may be chopped into flake particles of the invention. Examples include metal foils, paper, polymer films of many compositions and fibrous fabrics.

Chopping of Specific Defined Shapes—

Tools are available to cut films into flakes of a wide variety of shapes. Flakes may be produced of random shape, especially from chopping of brittle materials. Flakes may also be produced of specific, defined shapes, especially from die cutting of tough films resistant to breakage.

Printed Shapes—

The printing industry conventionally produces a wide variety of films bearing printings of specific defined shape. Further, conventional equipment is available to cut out printed shapes, providing flakes of specific defined shape and coloration.

Printed Particles Comprising Pictures, Marks, Logos or Slogans—

In a preferred embodiment, particles are printed using heat-resistant inks on a heat-resistant material, and cut out to provide flake particles of the invention bearing specific designs such as pictures, trademarks, logos and slogans of people or companies. Heat-resistant materials include, for example, paper, polymer films and metal foils, as well as films of layered composition.

Flake Particles Formed Between Releasing Surfaces—

A layer of conventional thermoset coating powder is deposited between two surfaces previously coated with a releasing agent. The assembly is pressed together and heated to a temperature high enough to melt the fusible powder into a film, but not high enough to substantially cure, or cross-link the film. The assembly is then cooled, and opened to release a brittle but fusible and curable film. The film is then be chopped into convenient flake particles between about 250 microns and several centimeters in length and width (or diameter) to provide fusible flake particles of the invention.

Fiber-Reinforced Flake Particles Formed Between Releasing Surfaces—

A layer of conventional thermoset coating powder was deposited between two surfaces previously coated with a releasing agent. A film comprising a loose assembly of fibers, such as non-woven "veil" fabric, or lightweight woven or knitted fabric was also deposited between the releasing surfaces. The assembly was pressed together and heated to a temperature high enough to melt the fusible coating powder into a film and to flow the molten coating around the fibers of the fiber assembly, but not high enough to substantially cure, or cross-link the film, or to damage the fibers. The assembly was then cooled, and opened to release a fiber-reinforced, fusible, curable film. The reinforced film was then chopped into convenient flake particles between about 0.5 and 3 centimeters in length and width to provide fiber-reinforced, fusible flake particles of the invention.

Three-Layer Flake Particles Formed Between Releasing Surfaces—

A three layer sandwich is assembled consisting of a first layer of conventional fusible thermoset coating powder, a second layer of a carrier film, and a third layer of a conventional fusible thermoset coating powder. The assembled sandwich is positioned between two surfaces previously coated with a releasing agent. The assembly is pressed together and heated to a temperature high enough to melt, but not high enough to cure the outer layers of fusible thermoset coating powder, or to damage the carrier film. The assembly is then cooled to solidify the melted films, and opened to release the three-layer composite comprising a carrier film coated on both sides by a fusible, curable surface layer. The three-layer film may then be chopped into convenient flake particles between about 250 microns and several centimeters in length and width (or diameter) to provide coated flake particles of the invention.

Variations in the Composition of Three-Layer Flakes—

The interior film, or carrier film of three-layer flakes may be of varied composition. For example, it may be of metal, such as steel, aluminum, copper, silver, or gold, etc.; of a high melting polymer; of a cellulosic composition such as paper; or of a fabric comprised of fibers.

Highly Reflective Flakes—

In a preferred embodiment of three-layer flakes the carrier film comprises a polymer film that has previously been metallized on one or both faces. Large, metallized, three-layer flake particles cut from such a film tend to lie flat when deposited on a workpiece, and may thus be used to form coatings of superior reflectivity to the coatings containing randomly oriented reflective particles familiar in the powder coating art.

Coated Flake by Powder Application—

Continuous film is heated and passed through a cloud of fusible coating powder, where it accumulates a layer of melted coating material. The coated film is subsequently passed out of the coating chamber, and cooled to solidify the coating melt. The film is then chopped into convenient sizes between about 250 microns and several centimeters in length and width (or diameter) to provide coated flake particles of the invention. The coating may optionally be both fusible and curable (or cross-linkable).

Coated Flake by Powder Application—

Continuous conductive film is passed through a cloud of electrostatically-charged coating powder, where it accumulates a layer of coating powder. The coated film is subsequently passed out of the coating chamber into an oven where the powder coating is heated enough to melt and flow out into surface films, but not enough to substantially cure the surface films. The multi-layer composition is then passed out of the oven and cooled to solidify the surface film. The solidified multi-layer film composition may then be chopped into convenient sizes between about 250 microns and several centimeters in length and width (or diameter) to provide coated flake particles of the invention. The coating may optionally be both fusible and curable (or cross-linkable).

Coated Flake by Liquid Application—

Continuous film is passed through a conventional liquid application system to provide a liquid layer on one or both sides of the film. This liquid layer or layers is then solidified by one of the many conventional processes, such as solvent evaporation, cooling, or polymerization to form a layer of solid coating on one or both faces of the film. The coated film is then chopped to convenient lengths between about 250 microns and several centimeters to provide coated flake particles of the invention. The formed coating may optionally be both fusible and curable (or cross-linkable).

Three-Layer Flake Particles of Several Shapes

Preparation of a Thermoset Binder Solution

To a 5-liter vessel fitted with a stirrer were sequentially added, with stirring: MIBK, 1000 grams; Toluene, 1000 grams; Crylcoat 2425 polyester resin, 1850 grams, obtained from DSM Resins, Inc.; PT-810 triglycidylisocyanurate, 250 grams, obtained from Huntsman Chemical Corp.; Modaflow 3, 26.0 g; Benzoin, 10.0 g; and Benzyltriethylammonium chloride, 2.00 grams. Stirring was continued until all components dissolve (approximately 10 minutes) to yield 4038 g of clear, colorless solution with a solids content of 51.7%.

Preparation of Binder-Coated Paper—

Red-colored paper 1.0 $m^2$, 90 grams, is coated on two sides with a total of 105 grams of the clear solution from the previous. The paper is baked at 100° C. for fifteen minutes, then cooled to yield 160 grams of coated paper about 85 μm thick, with an average of 30 μm of thermoset binder composition on each face.

Preparation of Decorative Flake Particles—

Coated paper from the previous example is chopped into a collection of several forms of red-colored flake particles, each about 85 μm thick and between about 5 and 10 mm in largest dimension. The forms are: equilateral triangles, squares, pentagons, hexagons, heptagons, octagons, crescent shapes, hearts, diamonds, clubs, spades, fish, butterflies, flowers, human head profiles, and alphabet letters.

Preparation of Reflective Flake Particles

A 25 μm thick film of poly-4-methylpentene that had previously been metalized on both sides with a layer of aluminum is passed through a powder coating system. A clear coating powder is applied to both sides of the film, to a film thickness of approximately 20 μm. The film is passed through an oven maintained at 130° C. After a residence time of approximately one minute, the film exits the oven, and is cooled by passing over a roller maintained at a temperature of less 20° C. The film is then chopped into regular hexagons 3 mm across.

Fiber-Reinforced Flake Particles—

A carbon-fiber containing woven fabric is passed through a powder coating system, where a clear powder coating is applied to the fabric. The coated fabric is passed through an oven maintained at 130° C., melting the coating powder and coating the fabric. After a residence time of approximately one minute, the film exits the oven, and is cooled by passing over a roller maintained at a temperature of less 20° C. The film is then chopped into flake particles.

Foam Particles

These particles of the invention are larger in all three dimensions than conventional powder coatings known in the art. If particles are described by length, width and thickness, foam particles have all three of these dimensions larger than about 250 microns, that is to say, length, width and thickness larger than 250 microns, for example 300 microns, or two millimeters, or one centimeter, or two centimeters or more.

Alternatively, if a conventional coating powder particle is described in terms of spherical diameter, a foam particles has a spherical diameter greater than 250 microns, for example: 300 microns, or two millimeters, or one centimeter, or two centimeters or more.

If these inventive particles were free of gas bubbles, or voids, they would have such large mass that they could not be transported conveniently and controllably on air. This limitation is avoided in foam particles because they contain gas voids.

Structure

The voids or gas bubbles in foam particles range in size from a few nanometers to larger sizes, such as 1 micron or 1 mm, or 1 cm, with a typical size range of 1 micron to 1 mm. These voids or bubbles may be filled with a variety of gasses, for example: air, nitrogen, argon, hydrogen, helium, water vapor, carbon dioxide, methane, ethane, propane, butane or other hydrocarbons, chlorofluorocarbons, etc., or may be substantially evacuated.

Gas voids fill a substantial fraction of the volume of foam particles, between 10 and 99 percent, typically between 50 and 95 percent.

Composition

Foam particles may be prepared from a variety of materials. They may be prepared from materials which melt under conditions typically used to form powder coating films, for example, oven temperatures from 100 to 250° C., or they may be prepared from infusible materials.

Fusible materials used to prepare foam particles may be thermoplastic polymers, thermosetting polymers, or combinations of these. Thermosetting compositions such as those used to prepare conventional powder coatings are especially useful. Compositions containing temperature-sensitive foam stabilizers are especially valuable.

In a preferred embodiment, foam particles are composed of melt-fusible materials such as may be used to prepare conventional thermosetting coating powders.

Preparation of Foam Particles of the Invention Foam Particles by Gas Injection—

A powder coating of conventional formulation is prepared by combining conventional powder coating components, for example: a carboxylic acid-functional binder resin, for example Crylcoat 2425; an acid reactive curing agent, such as a polyepoxy, for example triglycidylisocyanurate, or a polyhydroxyalkylamide, for example N,N,N',N'-tetrakis-(2-hydroxyethyl)adipamide; a degassing aid, for example benzoin; a leveling aid, for example a low-melting acrylic polymer, for example Modaflow 3; and a cure catalyst, for example an ammonium or phosphonium halide, such as benzyltriethylammonium chloride.

The components are combined by dry blending, then are fed to a co-rotating twin screw extruder, where heat and shear is applied to melt the composition, and blend it thoroughly to form a compact, essentially void free melt blend.

At this stage, the conventional powder coating processes is to allow the compact melt-blend to exit the extruder, then to cool it by passing between chilled rollers to solidify the melt-blend into a friable solid. In the invention, the extruder may be modified to allow foaming of the melt blend as follows: provide extruder elements after the mixing zone to create a melt seal; downstream from the melt seal, supply a port for introducing gas under pressure; supply additional extruder screw elements for mixing the gas into the melt downstream of the port; and supply an orifice with a restricted cross section when compared to conventional powder coating extruders.

The modified extruder is used as follows. Downstream from the melt-seal, gas is introduced under pressure. This gas is blended with the melt, i.e. the molten blend of raw materials, to prepare a blend of raw materials and gas under pressure. This pressurized composition is allowed to exit the extruder through the restricted orifice to a region of lower pressure. In the region of lower pressure, the gas expands, creating bubbles or voids in the melt blend. Expansion of the gas also supplies adiabatic cooling and stiffens, or raises the viscosity, of the melt blend. This stiffening prevents coalescence of the gas bubbles, and escape of the gas.

The expanded, void-containing melt blend is then cooled by conventional means, for example passing onto a cooled belt and passing into a stream of cold air. After cooling, the hard, void-filled extrudate is chopped into foam particles of convenient size.

Alternatively, the expanded, void-containing, high viscosity melt blend may be passed between chilled rollers to shape the extrudate into a thinner, but still void-filled sheet. This sheet is then broken into flattened particles intermediate between flake form and foam form.

Foam Particles by Liquid Boiling—

In an alternative foaming process, a low-boiling liquid non-solvent is introduced into the compact melt blend after the melt seal. This liquid is blended with the melt, the blend is then allowed to exit the extruder through the restricted orifice to a region of lower pressure. In the region of lower pressure, the low-boiling liquid boils to a gas, creating bubbles or voids in the melt blend. Boiling of the liquid also supplies adiabatic cooling and stiffens, or raises the viscosity, of the melt blend. This stiffening prevents coalescence of the gas bubbles, and escape of the gas.

The expanded, void-containing melt blend is then cooled by conventional means, for example passing onto a cooled belt and passing into a stream of cold air. After cooling, the hard, void-filled extrudate is broken or cut into foam particles of convenient size.

The fate of the low-boiling liquid depends on its composition. Liquids such as carbon dioxide or butane that are gases at typical environmental conditions remain gaseous. Liquids such as pentane and water that are liquids at typical environmental pressures condense as the melt is cooled, and liquefy again. Being non-solvents, they do not soften the foam particles, and later escape when the particles are re-melted and cured to form coatings or structures.

Foam Particles from Supercritical Fluid—

Some gas-producing materials may be neither liquid nor gaseous at the temperatures and pressures of the mixing zone inside the extruder, but are better described as supercritical fluids. Such fluids also expand when the fluid/melt blend passes out of the extruder through a restricted orifice to a region of lower pressure, creating voids in the melt, and providing adiabatic cooling in the same way that pressurized gases and low-boiling liquids do. A material that may achieve the supercritical state in an extruder is carbon dioxide.

Foam Particles from Blowing Agent—

Foam particles of the invention may also be prepared by modifying a conventional powder coating composition by the addition of one or more blowing agents, that is, compounds that decompose when heated, to produce gas. For example, 100 parts of a conventional coating composition may be modified by the addition of from 0.5 to 10 parts of a blowing agent such as azo-bis-isobutyronitrile (AIBN).

Upon melt blending in an extruder, the blowing agent decomposes with the production of gas, creating gas bubbles and dissolved gas in the extrudate, and creating pressure in the extruder. This foamed material exits the extruder, and expands in the region of reduced pressure outside, where it is allowed to cool and solidify. Expansion of the gas produces adiabatic cooling and stiffens, or raises the viscosity, of the melt blend. This stiffening prevents coalescence of the gas bubbles, and escape of the gas.

The expanded, void-containing melt blend is then cooled by conventional means, for example passing onto a cooled belt and passing into a stream of cold air. After cooling, the hard, void-filled extrudate is chopped into foam particles of convenient size.

Gas Expansion in a Zone of Reduced Pressure—

A modification of the above methods of foam production, a region of reduced pressure is provided downstream of the extruder. For example, a chamber that may be evacuated is attached to the exit port of the extruder. The chamber is evacuated below atmospheric pressure, to increase the pressure differential between the inside and outside of the extruder, increasing adiabatic expansion and cooling.

Large Particles of Intermediate Forms—

The terms "fiber," "flake," and "foam" describe extremes of form of inventive particles. Many large particles of the invention may be intermediate, or between these extremes in form. For example, a particle of 5×100×500 microns, might be described as a 'short fiber' or as a 'long flake.' Similarly, a particle of 50 microns×500 microns×700 microns, with a void fraction of 80% might be described as a bubbly flake or as a flat foam.

Spray Gun with Internal High Voltage Electrode—

Figure 20:
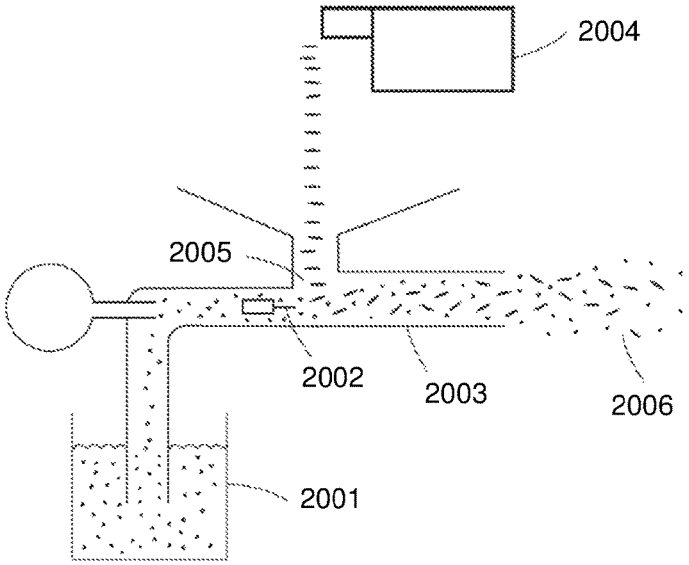

FIG. 20 illustrates an embodiment of the invention in which a high voltage electrode is contained inside the body of a spray gun rather than positioned at the exit nozzle. FIG. 20 is a confluent system in which a powder coating is pumped from fluid bed 2001 through an internal venturi at a first rate, then directed past a high voltage electrode 2002 mounted in the powder stream into a larger diameter mixing chamber 2003. At the same time, large particles are metered into an open funnel by feeder 2004 at a second rate. From the funnel the large particles are drawn into the gun through the open funnel feed port 2005 entering the gun directly downstream of the high voltage electrode and passing thence into the large diameter mixing chamber 2003. Both the powder particles and large particles pick up an electric charge in the mixing chamber, and flow from the spray gun as a charged cloud of mixed particles whose composition is defined by the ratio of the first and second rates.

Coating with Improved Cut Resistance Prepared Using the Apparatus of FIG. 20 is Discussed Below.

A spray gun designed as depicted in FIG. 20 was used to apply a coating with improved cut resistance as follows. A thermosetting polyester powder coating, Ocean Blue, from TCI Powder Coatings in Ellaville, Ga. was suspended on a flow of dry air in fluid bed 2001. Powder was pumped from the fluid bed into a spray gun using a flow of dry air through an internal venturi, at a flow rate of about 0.18 grams per second. After passing through the venturi, the powder-in-air suspension was directed past electrode 2002 held at a potential of about 70 kilovolts, then directed into mixing tube 2003 with diameter of about 3 cm. At the same time, a glass flake material from Glassflake, Ltd. of Leeds, England, grade GF-100, with a nominal thickness of 1.0-1.3 μm, and a particle size distribution such that 80% of the particles were between 150 and 1700 μm in largest dimension (length, width, or diameter) was fed by vibratory bowl feeder 2004 at a rate of 0.02 grams per second into an open funnel affixed to the spray gun immediately downstream of the high voltage electrode. The powder-in-air suspension flowing past the open funnel port 2005 into the mixing tube 2003 drew air and glass flake through the open funnel port into the mixing tube immediately downstream of the high voltage electrode where both powder particles and glass particles acquired electrostatic charge. The flowing cloud of charged particles 2006, consisting of thermosetting powder coating and glass flake in a 9:1 ratio, was directed out of the gun toward a grounded steel workpiece, where it accumulated in an adherent bed of powder particles and glass flake. The coated steel workpiece was heated in an air-circulating oven for 10 minutes at about 200° C., then cooled to yield a steel workpiece coated with a 9:1 polyester matrix/glass flake composite film. In subsequent testing, the glass flake composite was found to have superior cut resistance to a coating film of Ocean Blue coating prepared without included glass.

Large Particle Solid Coatings

Particles are disclosed that are substantially larger in mass, and substantially larger in at least one physical dimension than conventional coating powders, but may be applied by aerosol equipment. These large particles are solid in form, and are useful for preparing coatings with unusual appearance or unusual physical properties, such as impact resistance, flexibility, and electrical conductivity. Particle application equipment modified to efficiently apply substantially-larger coating particles is also disclosed.

For simplicity, the large coating precursor particles of these inventions may be referred to as megaparticles.

Megaparticles are formulated coating precursor particles that have significantly larger mass, and at least one physical dimension that is significantly larger than dimensions of conventional powder coating particles known in the art. Despite their relatively large mass, they can be applied by the typical powder processes of fluidization, aerosol transfer, and electrostatic attraction because they have volume-specific surface area ($S_v$) similar to that of conventional powder coatings.

Like conventional coating powders, a collection of megaparticles of a single composition may be applied to make films of uniform composition. Megaparticles of different compositions may be applied as blends, to form films of varied composition. Megaparticles of different shapes may be applied together. They may be applied as blends with coating particles known in the art. They may be applied in blends of coating particles and other particulate materials such as pigments, surface modifying agents, curing agents, etc. as known in the art.

Volume-Specific Surface Area ($S_v$)—

As used herein, the volume-specific surface area of a particle is the ratio of its surface area to its solid volume, excluding any gas bubbles or voids in the particle.

$$S_v = A/(V-B)$$

Where: $S_v$ is volume-specific surface area of the particle; A is surface area of the particle; V is the volume of the particle; and B is the volume of gas bubbles or voids in the particle.

For convenience herein, surface areas will be measured in square microns ($\mu^2$). Volumes will be measured in cubic microns ($\mu^3$). The units of $S_v$ herein are therefore $\mu^2/\mu^3$ or $\mu^{-1}$.

Conventional coating powders are generally approximated as spheres with typical diameters ranging from about 1 to about 250 microns, and a preferred range from about 10 to about 150 microns.

Particles below 10 microns in diameter develop strong inter-particle forces and tend to fluidize poorly. For this reason, coating powder manufacture is controlled to minimize these particles. Particles over about 150 microns in diameter are not readily suspended on moving air, and carried to a work piece for application. Because these large particles cannot be applied efficiently, coating powder manufacture is conventionally controlled to minimize these particles. Table 1, as shown in FIG. 21, lists the volume-specific surface areas of particles over the entire range for coating powders, and of example particles in the desirable range.

Megaparticle Forms

Megaparticles may be manufactured in several forms, that, for convenience may be approximated as fiber, plate and crumb forms. These terms are for convenience in description only. Intermediate forms may be prepared, and forms may be combined.

Fiber-Form Megaparticles

These inventive particles have two physical dimensions that are similar to those of conventional of powder coatings known in the art. These may be thought of as width and thickness, or as circular diameter. The circular diameter of these particles may be, for example, from about 1 to about 250 microns. The third dimension of these particles, length, may range from about 250 microns to much longer, for example 300 microns, or two millimeters, or one centimeter, or two centimeters, or more.

The cross section of the fiber-form particle may be regular, such as circular, ellliptical, square, rectangular or star-shaped, etc, or may be irregular.

The surface area of long cylindrical fibers is mostly made up of the circular surface of the shaft of the fiber, with little contribution from the cylinder ends. Using this simplification, fiber-form megaparticles of various cross sections having the same volume-specific surface areas ($S_v$) as conventional powder coatings may be defined. Because they match the $S_v$ of conventional particles, these particles may be fluidized and applied using aerosol spray equipment. See Table 2 for an illustration of the diameters of these inventive megaparticles.

Fiber-form megaparticles may also be approximated as long fibers of square cross-section with side length L. Using this simplification, fiber-form megaparticles of various cross sections having the same volume-specific surface areas ($S_v$) as conventional powder coatings may be defined. Because they match the $S_v$ of conventional particles, these particles may be fluidized and applied using aerosol spray equipment. See Table 2 for an illustration of the side length of these inventive megaparticles.

Number—

Fiber-form megaparticles may comprise a single fiber, or may also comprise assemblies of two, or a dozen, or a hundred individual fibers, or 12,000 or 50,000 or more fibers as provided in conventional roving bundles.

Coatings—

Individual fiber-form megaparticles may comprise fibers or fiber bundles that are uncoated, or they may be coated with one or more fusible or infusible layers of non-fibrous matrix material, or of combinations of fusible and infusible layers, or coated with fusible, curable compositions. Fibers may be individually coated, or coated as a group.

Curable compositions may comprise, but are not limited to the following general binder types commonly used in powder coatings: epoxy epoxy-polyester hybrid, triglycidyl isocyanurate-cured polyester, hydroxyalkylamide-cured polyesters, urethane-cured polyesters, acid-functional acrylics, hydroxyl-functional acrylics, epoxy-functional acrylics, ultraviolet-light-curable compositions and fluorocarbons.

Composition

Fibers in fiber-form megaparticles may be prepared from many materials, including, but not limited to: metals such as aluminum, stainless steel and nickel; inorganic oxide glasses such as E glass and S glass; carbon, man-made organic polymers, such as: polyolefins such as polyethylene and polypropylene, polyesters such as polyethylene terephthalate and polybutylene terephthalate, polyamides such as Nylon 6,6 or Nylon 6, polyaramides such as Kevlar, cellulosics such as Rayon and cellulose acetate; natural fibers such as wood, Jute, Kenaf, Hemp, Linen, Cotton, Silk and wool. Fibers may be clear or opaque, pigmented or naturally colored.

Thermal Behavior—

Plate-form megaparticles may be formed form from materials that undergo one or more changes such as softening, melting, or crosslinking at the time the assemblage of particles is melted to form a coating film, or may undergo no change.

Preparation of Fiber-Form Megaparticles

Fiber-form particles may simply be fiber material cut to the desired length. They may also be prepared by coating long individual fibers or bundles of fibers, then cutting to length, or may be prepared by coating pre-cut fibers.

Application of Fiber-Form Megaparticles

Fiber-form megaparticles may be applied from a fluid bed, either neutral or electrostatic. Smaller versions may be applied using conventional powder coating transfer and application equipment. To obtain the advantages offered by especially long particles, handling and spray equipment with large tubing diameter, or "megabore" spray equipment, may be used. See the Large Particle Application Equipment section for descriptions of megabore particle handling and application equipment.

Utility—

In one embodiment, these inventive particles are especially useful because than can comprise infusible fibers. Depending on their composition, infusible fibers may improve coating films in a variety of ways. For example, fibers with high tensile strength may improve the tensile strength, crack resistance and flexibility of coatings. Electrically conductive fibers may be used to impart electrical conductivity to the film. Thermally conductive fibers may be used to impart thermal conductivity to the film.

Fiber-form megaparticles may be used with or without other particles to manufacture composite resin/matrix structure. A coating film manufactured using fiber-form megaparticles may be used as a layer of a composite structure to provide improved properties.

Plate-Form Megaparticles

These inventive particles have one physical dimension that is similar to that of conventional powder coatings, for example thickness from 1 to 250 microns, and two dimensions that are larger. These other two dimensions may be described in various ways, for example as length and width, or as circular diameter. In a plate-form megaparticle these other two dimensions are larger than a conventional coating particle, that is, greater than 250 microns, for example 300 microns, or two millimeters, or one centimeter, or more.

The surface area of a plate-form, flat, or disc-shaped particles is mostly made up of the top and bottom faces, with little contribution from the thin edge. Using this simplification, plate-form megaparticles of various cross sections having the same volume-specific surface areas ($S_v$) as conventional powder coatings may be defined. These inventive megaparticles may be fluidized and applied using aerosol spray equipment. See Table 3, as shown in FIG. 23, for an illustration of plate-form particles that may be prepared and applied.

Multiple Layers, Materials and Thermal Behaviors—

Plate-form megaparticles may be formed form one layer or from multiple layers of the same or different materials. Layers may be flexible or ridged. Individual layers may undergo one or more changes such as softening, melting, or crosslinking at the time the assemblage of particles is melted to form a coating film, or may undergo no change.

Composition—

The materials from which plate-form megaparticles may be composed include, but are not limited to glass, metal, mica, paper, natural and man-made polymers and glass. These particles may be prepared from a single material, or blends of materials, including fully-formulated, curable systems such as are conventionally used to form coatings powders.

Curable compositions may comprise, but are not limited to the following general binder types commonly used in powder coatings: epoxy epoxy-polyester hybrid, triglycidyl isocyanurate-cured polyester, hydroxyalkylamide-cured polyesters, urethane-cured polyesters, acid-functional acrylics, hydroxyl-functional acrylics, epoxy-functional acrylics, ultraviolet-light-curable compositions and fluorocarbons.

Plate-form megaparticles may contain one or more types of fibers. Fibers may be unidirectional, may be randomly oriented, may be oriented in patterns, and may be woven.

Appearance—

In visual aspect plate-form megaparticles may be variously clear, opaque, pigmented, patterned, or reflective, or combinations of these attributes. The surface may be high gloss, mid gloss, satin, low gloss, flat, textured, or oxidized, or combinations of these.

Application—

At the time an assemblage of particles is heated to form a film, a plate-form particle may exhibit a variety of thermal behaviors, including, but not limited to: non-softening, conformable softening, melting, shrinking, expansion, and crosslinking or curing.

Plate-form megaparticles, with or without fusible polymer coatings, may be applied in combination with conventional powder coatings or with other megaparticles.

In a preferred embodiment, plate-form megaparticles contain on their large faces fusible, curable compositions that may coalesce with other coating particles or megaparticles to form cured films.

In a preferred embodiment, a plate form megaparticle comprises an inner layer of highly reflective material, and two outer layers of clear, fusible, curable polymer.

In a preferred embodiment, a plate-form megaparticle comprises an inner layer of, opaque, pigmented material, and two outer layers of clear, fusible curable polymer.

Within the limits of the plate-form definition, particles may be random in shape, or they may have any one of a variety of non-random shapes, including, but not limited to: squares, rectangles, diamonds, truncated squares, regular polygons with 3, 4, 5, 6, 7, 8 or mores sides, circles, ovals, star-shapes, heart-shapes, shapes like a club or a spade, shaped like animals, birds, fish, people or any of the myriad shapes into which plate-form or sheet form materials may be cut, stamped, or formed.

Utility—

Plate-form megaparticles have extremely broad utility. They provide access to coating films with large scale color variation. They provide access to the decorative potential of recognizable shapes. They provide a means of preparing metallic coatings of high reflectivity. They can be used to improve the tensile strength and modulus of coatings. They may also improve other properties such as flexural strength and modulus, compressive strength and modulus. Fiber-containing plate-form megaparticles are especially useful for these application. Electrical conductive and dissipative properties may be improved using flake megaparticles. Thermal conductive and dissipative properties may be improved using flake megaparticles. A coating film manufactured using flake megaparticles may be used as a layer of a composite structure to provide improved properties.

Application—

Plate-form megaparticles may be applied from a fluid bed, either neutral or electrostatic. They may be applied by spray equipment. Conventional spray equipment may be used in some cases, but to obtain the advantages offered by especially large particles, spray equipment with large tubing diameter, or "megabore" spray equipment, may be used.

Preparation

Plate-form particles may be prepared in a variety of ways. They may be prepared by cutting or chopping a film of one or more layers into desired shapes. Multilayer films may be prepared by known techniques beginning with a carrier layer of metal, polymer or fabric. For example a polymer film may be metallized, a metallized polymer may be coated with a liquid, then dried, or may be coated with a powder which is then fused to a film. Many conventional processes are known for preparing coated films and multilayer films.

Crumb-Form Megaparticles

This third form of inventive particles is larger in all three dimensions than conventional powder coatings known in the art. If particles are described by length, width and thickness, a completely crumb-form megaparticle has all three of these dimensions larger than about 250 microns, that is to say, length, width and thickness larger than 250 microns, for example 300 microns, or two millimeters, or one centimeter, or more.

Alternatively, if a conventional coating powder particle is described in terms of spherical diameter, a crumb-form megaparticle has a spherical diameter greater than 250 microns, for example: 300 microns, or two millimeters, or one centimeter, or more. If these inventive particles were free of gas bubbles, or voids, they would have large solid volumes, and hence, volume-specific surface areas, $S_v$ smaller than about $0.024\mu^{-1}$. As known in the art, such particles do not fluidize well, and are not easily carried in an aerosol transfer system. This limitation is avoided in crumb-form megaparticles because they contain gas voids.

The presence of gas bubbles, or voids in inventive crumb-form particles reduces their solid volumes, and maintains their volume-specific surface areas, $S_v$ larger than about $0.024\ \mu^{-1}$.

Table 4, as shown in FIG. 24, lists the volume-specific surface area, $S_v$, of three conventional particles of 150, 50 and 250 microns. For three selected diameters of crumb-form megaparticle, Table 2 also illustrates the void fraction of the crumb-form particle required in order to maintain the same $S_v$, as the conventional particle, and, and allow particle fluidization and aerosol transfer. Table 4 also lists the solid volume of the crumb-form megaparticle as a multiple of the solid volume of the conventional particle. These solid volume multiples, or mass multiples, of 4 to 400 demonstrate the utility of crumb-form megaparticles for applying large regions of coating from one particle. For example, blends of such particles, if differently colored, would produce large areas of color variation.

Structure

The voids or gas bubbles in crumb-form megaparticles range in size from a few nanometers to larger sizes, such as 1 micron or 1 mm, or 1 cm, with a typical size range of 1 microns to 1 mm. These voids or bubbles may be filled with a variety of gasses, for example: air, nitrogen, argon, hydrogen, helium, water vapor, carbon dioxide, methane, ethane, propane, butane or other hydrocarbons, chlorofluorocarbons, etc., or may be substantially evacuated.

Gas voids fill a substantial fraction of the volume of crumb megaparticles, between 10 and 99 percent, typically between 50 and 95 percent.

Composition

Crumb-form megaparticles may be prepared from a variety of materials. They may be prepared from materials which melt under conditions typically used to form powder coating films, for example, oven temperatures from 100 to 300° C., or they may be prepared from infusible materials.

Fusible materials used to prepare crumb megaparticles may be thermoplastic, thermosetting, or combinations of these. Thermosetting compositions such as those used to prepare conventional powder coatings are especially useful. Compositions containing temperature-sensitive foam stabilizers are especially valuable.

In a preferred embodiment, crumb-form megaparticles are composed of melt-fusible materials such as may be used to prepare conventional thermosetting coating powders.

In a preferred embodiment, crumb-form megaparticles are composed of melt-fusible materials such as may be used to prepare conventional thermosetting coating powders, and comprise one or more air-release agents such that the gas bubbles coalesce or voids collapse when the particles melt.

In a preferred embodiment, crumb-form megaparticles comprise materials that melt to low viscosity, such that when the particle melts it flows rapidly to form a discrete area much larger in size that that observed from the melting of a single conventional coating particle.

Crumb megaparticles may contain fiber or flake components of various composition.

Preparation—

Crumb-form megaparticles may be prepared by known methods for preparing polymer compositions. For example, components may be dry-blended, then melt-mixed.

Gas voids may be incorporated into the polymer melt using a variety of known techniques. Examples of these techniques include:

Gas under pressure may be introduced into the polymer melt. Upon discharge of the polymer melt to into a region of lower pressure, expansion of the gas produces gas voids and adiabatic cooling. This cooling may be used to solidify the polymer melt.

Supercritical fluids may be used to soften or dissolve components of a polymer. Carbon dioxide may be a useful gas for this application.

Blowing agents may be incorporated into a polymer composition. Heating of the composition, such as is typically done during extrusion decomposes the blowing agent to produce gas voids.

Liquids may be introduced into a polymer melt under pressure at elevated temperatures. Upon transfer of the composition to a region of lower pressure, the liquid changes to a gas, creating voids in the plastic material. For example, water at temperatures above 100° C. and pressures above atmospheric flashes to steam if the pressure is suddenly released. Other materials such as butane and carbon dioxide have been similarly used to produce voids.

Application—

Crumb megaparticles may be applied in several ways.

Fluid beds designed for conventional powder coatings fluidize megaparticles. Both non-electrostatic or neutral fluid beds and electrostatic fluid beds may be used to fluidize and apply megaparticles.

They may be applied by spray equipment. Conventional spray equipment may be used in some cases, but to obtain the advantages offered by especially large particles, the fluid passages in electrostatic spray guns and bells designed for conventional powder coatings may be too narrow for megaparticle fluids, and may need to be resized. See the Large-Particle Application Equipment section for more information.

Fusible crumb-form megaparticles may be applied by themselves or in combination with conventional powder coatings or with other megaparticles. Non-fusible crumb-form megaparticles may be applied in combination with conventional powder coatings or with other megaparticles.

Utility—

Crumb megaparticles have varied utility. They provide access to coating films with large scale color variation, and to thick coating films. Versions containing fibers can be used to improve the tensile strength and modulus of coatings. They may also improve other properties such as flexural strength and modulus, compressive strength and modulus. Electrical conductive and dissipative properties may be improved using compositions containing electrically conductive fibers. Thermal conductive and dissipative properties may be improved using compositions containing thermally conductive fibers. A coating film manufactured using crumb megaparticles may be used as a layer of a composite structure to provide improved properties.

Intermediate Megaparticle Forms—

The terms "fiber," "plate," and "crumb" describe extremes of megaparticle form. Many megaparticles may be intermediate, or between these extremes in form. For example, a megaparticle of 5×100×500 microns, might be described as a 'short fiber' or as a 'long plate.' Similarly, a particle of 50 microns×500 microns×700 microns, with a void fraction of 80% might be described as a bubbly plate or as a flat crumb.

Aerodynamic Factors—

Aerodynamic factors other than high specific surface area may contribute to the capacity for aerosol transfer of certain megaparticle shapes such as discs and crumb. These factors include the low sphericity of shapes like plates and flattened crumb forms.

EXAMPLES

Fiber-Form Megaparticles

Inventive Example 1—Fiber Reinforced Coating

Glass fibers commercially available as a chopped strand product with individual fibers between 4 and 10 mm in length and 4-20 microns in diameter are blended in a fluid bed with a conventional powder coating. This blend is applied through spray equipment with conventional bore diameters to a pre-heated metal part to produce a glass-reinforced powder coating film.

Inventive Example 2—Fiber Reinforced Coating

A spray application is set up in which one or more conventional powder delivery devices, powder "guns" or "bells" delivers electrostatically-charged powder, and a chopped strand spray gun delivers electrostatically-charged glass fiber such as a chopped strand glass with individual fibers between 4 and 10 mm in length and 4-20 microns in diameter. The powder and glass aerosols are directed toward and deposited on a grounded part with a conductive surface. The coated part is subsequently heated to melt the fusible powder, incorporate the glass fibers, producing an article coated with a glass-reinforced film.

Inventive Example 3—Fiber Reinforced Coating

In a spray application such as Example 2, electrostatic charging of the conventional coating powder and the glass is accomplished not in the spray delivery device, but by independent high voltage electrodes in the application chamber, such as a charged wires.

Inventive Example 4—Fiber Form Megaparticles

Continuous glass fiber or continuous fiber bundles are heated to between 100 and 200° C. and passed through a coating powder cloud, where they accumulate a layer of melted coating material. The coated fiber or coated fiber bundles is subsequently passed out of the coating chamber, and cooled to solidify the coating melt. The fiber or fiber bundles are then chopped to convenient lengths between about 4 and about 20 mm to provide fiber-form megaparticles. The formed large particles may be applied through conventional powder spray equipment, or though spray equipment with enlarged internal diameter to produce a fiber-reinforced film.

Inventive Example 5—Fiber Form Megaparticles

Continuous carbon fiber or fiber bundles are passed through a liquid application system to provide a liquid layer of coating binder precursor on the fiber. This liquid layer is solidified by one of the many conventional processes, such as solvent evaporation, cooling, or partial polymerization. The fiber or fiber bundles are then chopped to convenient lengths, between about 4 and about 20 mm to provide fiber-form megaparticles.

Inventive Example 6—Fiber Form Megaparticles

In a manner analogous to Example 5, continuous fibers or fiber bundles of many different compositions are coated, for example natural fibers such as cotton, flax, hemp, jute, silk and wool, and man-made fibers such as rayon, polyester, acrylic, polypropylene, polyethylene, polyamide and polyaramide, or mixtures of natural fibers, or mixtures of man-made fibers, or mixtures of natural and man-made fibers.

The fiber or fiber bundles are then chopped to convenient lengths between about 4 and about 20 mm to provide fiber-form megaparticles.

Plate-Form Megaparticles

Inventive Example 7, Plate-Form Three-Layer Megaparticles of Several Shapes

Example 7a: Preparation of a Thermoset Binder Solution

To a 5-liter vessel fitted with a stirrer are sequentially added, with stirring: MIBK, 1000 grams; Toluene, 1000 grams; Crylcoat 2425 polyester resin, 1850 grams, obtained from DSM Resins, Inc; PT-810 triglycidylisocyanurate, 250 grams, obtained from Huntsman Chemical Corp.; Modaflow 3, 26.0 g; Benzoin, 10.0 g; Benzyltriethylammonium chloride, 2.00 grams. Stirring is continued until all components dissolve (approximately 10 minutes) to yield 4038 g of clear, colorless solution with a solids content of 51.7%.

Example 7b, Preparation of Binder-Coated Paper

Red-colored paper 1.0 $m^2$, 90 grams, is coated on two sides with a total of 105 grams of the clear solution from Example 7a. The paper is baked at 100° C. for fifteen minutes, then cooled to yield 160 grams of coated paper about 0.085 mm thick, with an average of 30 μm of thermoset binder composition on each face.

Example 7c, Preparation of Decorative Plate-Form Megaparticles

Coated paper from Example 7b is chopped into a collection of several forms of red-colored plate-form megaparticles, each about 0.085 mm thick and between about 5 and 10 mm in largest dimension. The forms are: equilateral triangles, squares, pentagons, hexagons, heptagons, octagons, crescent shapes, hearts, diamonds, clubs, spades, fish, butterflies, flowers, human head profiles, and alphabet letters.

Example 8, Application of Plate-Form Megaparticles to Form a Decorative Film 50 grams of red-colored, plate-form megaparticles from Example 7c are combined with 950 grams of a clear powder coating in a fluid bed. Using a megabore spray gun with tubes, hoses, and internal gas passages of >12 mm, the fluidized blend of powder coating and Example 7c megaparticles are applied to white-primed metal panels. The panels are baked 10 minutes at 175° C. to produce a glossy white surface decorated with the various red shapes of Example 7c.

Example 9a, Preparation of Reflective Plate-Form Megaparticles

A 5 μm thick film of poly-4-methylpentene that had previously been metalized on both sides with a layer of aluminum is passed through a powder coating system. A clear coating powder is applied to both sides of the film, to a film thickness of approximately 40 μm. The film is passed through an oven maintained at 130° C. After a residence time of approximately one minute, the film exits the oven, and is cooled by passing over a roller maintained at a temperature of less 20° C. The film is then chopped into regular hexagons 3 mm across.

Example 9b, Preparation of a Highly-Reflective Film

The reflective, hexagonal, plate-form megaparticles from Example 9a are to a grounded steel chair base applied using conventional powder coating equipment. The particle-coated chair base is then baked at 175° C. for 15 minutes to melt the coating on the metalized particles, and coalesce them into a smooth film with reflectivity greater than 90%.

Example 13a Fiber-Reinforced Plate-Form Particle

A carbon-fiber containing woven fabric is passed through a powder coating system, where a clear powder coating is applied to the fabric. The coated fabric is passed through an oven maintained at 130° C., melting the coating powder and coating the fabric. After a residence time of approximately one minute, the film exits the oven, and is cooled by passing over a roller maintained at a temperature of less 20° C. The film is then chopped into plate-form megaparticles.

Example 13b—Reinforced Film From Megaparticles

Plate-form megaparticles from 13a are applied through aerosol powder coating equipment with conventional, or with oversized internal passages to a pre-heated part. The coating on the fabric melts, coalesces the particles into a film, which crosslinks, or cures, to a fiber-reinforced film.

Fabric-reinforced plate-form megaparticles from 13a of low conductivity may be applied to a grounded, room temperature part. Heating of the part in an oven in a conventional manner melts the applied coating and produces a reinforced coating film.

Crumb-Form Megaparticles

Example 10a—Crumb Form Particles by Extruder Foaming

A powder coating of conventional formulation is prepared by combining conventional powder coating components, for example: A carboxylic acid-functional binder resin, for example Crylcoat 2425; An acid reactive curing agent, such as a polyepoxy, for example triglycidylisocyanurate, or a polyhydroxyalkylamide, for example N,N,N',N'-tetrakis-(2-hydroxyethyl)adipamide; A degassing aid, for example benzoin; A leveling aid, for example a low-melting acrylic polymer, for example Modaflow 3; and A cure catalyst, for example an ammonium or phosphonium halide, such as benzyltriethylammonium chloride.

The components are combined by dry blending, then are fed to a co-rotating twin screw extruder, where heat and shear is applied to melt the composition, and blend it thoroughly to form a compact, essentially void free melt blend.

At this stage, the conventional powder coating processes is to allow the compact melt-blend to exit the extruder, then to cool it by passing between chilled rollers to solidify the melt-blend into a friable solid. In the invention, the extruder may be modified to allow foaming of the melt blend as follows: Provide extruder elements after the mixing zone to create a melt seal; Downstream from the melt seal, supply a port for introducing gas under pressure; Supply additional extruder screw elements for mixing the gas into the melt downstream of the port; and Supply an orifice with a restricted cross section when compared to conventional powder coating extruders.

The modified extruder is used as follows. Downstream from the melt-seal, gas is introduced under pressure. This gas is blended with the melt, i.e. the molten blend of raw materials, to prepare a blend of raw materials and gas under pressure. This pressurized composition is allowed to exit the extruder through the restricted orifice to a region of lower pressure. In the region of lower pressure, the gas expands, creating bubbles or voids in the melt blend. Expansion of the gas also supplies adiabatic cooling and stiffens, or raises the viscosity, of the melt blend. This stiffening prevents coalescence of the gas bubbles, and escape of the gas.

The expanded, void-containing melt blend is then cooled by conventional means, for example passing onto a cooled belt and passing into a stream of cold air. After cooling, the hard, void-filled extrudate is chopped into crumb-form megaparticles of convenient size.

Example 10b—Flattened, Crumb-Form Megaparticles

Alternatively, the expanded, void-containing, high viscosity melt blend may be passed between chilled rollers to shape the extrudate into a thinner, but still void-filled sheet. This sheet is then broken into flattened megaparticles intermediate between plate form and crumb form.

Example 10c—Crumb-Form Megaparticles by Liquid Boiling

In an alternative foaming process, a low-boiling liquid non-solvent is introduced into the compact melt blend after the melt seal. This liquid is blended with the melt, the blend is then allowed to exit the extruder through the restricted orifice to a region of lower pressure. In the region of lower pressure, the low-boiling liquid boils to a gas, creating bubbles or voids in the melt blend. Boiling of the liquid also supplies adiabatic cooling and stiffens, or raises the viscosity, of the melt blend. This stiffening prevents coalescence of the gas bubbles, and escape of the gas.

The expanded, void-containing melt blend is then cooled by conventional means, for example passing onto a cooled belt and passing into a stream of cold air. After cooling, the hard, void-filled extrudate is broken or cut into crumb-form megaparticles of convenient size.

The fate of the low-boiling liquid depends on its composition. Liquids such as carbon dioxide or butane that are gases at typical environmental pressures remain gaseous. Liquids such as pentane and water that are liquids at typical environmental pressures condense as the melt is cooled, and liquefy again. Being non-solvents, they do not soften the crumb megaparticles, and later escape when the particles are re-melted and cured to form coatings or structures.

Example 10d—Crumb-Form Megaparticles From Supercritical Fluid

Some gas-producing materials may be neither liquid nor gaseous at the temperatures and pressures of the mixing zone inside the extruder, but are better described as supercritical fluids. Such fluids also expand when the fluid/melt blend passes out of the extruder through a restricted orifice to a region of lower pressure, creating voids in the melt, and providing adiabatic cooling in the same way that pressurized gases and low-boiling liquids do. A material that may achieve supercritical form in an extruder is carbon dioxide.

Example 11—Crumb-Form Megaparticles from Blowing Agents

Crumb-form megaparticles may also be prepared by modifying a conventional powder coating composition by the addition of one or more blowing agents, that is, compounds that decompose when heated, to produce gas. For example, 100 parts of a conventional coating composition may be modified by the addition of from 0.5 to 10 parts of a blowing agent such as azo-bis-isobutyronitrile (AIBN).

Upon melt blending in an extruder, the blowing agent decomposes with the production of gas, creating gas bubbles and dissolved gas in the extrudate, and creating pressure in the extruder. This foamed material exits the extruder, and expands in the region of reduced pressure outside, where it is allowed to cool and solidify. Expansion of the gas produces adiabatic cooling and stiffens, or raises the viscosity, of the melt blend. This stiffening prevents coalescence of the gas bubbles, and escape of the gas.

The expanded, void-containing melt blend is then cooled by conventional means, for example passing onto a cooled belt and passing into a stream of cold air. After cooling, the hard, void-filled extrudate is chopped into crumb-form megaparticles of convenient size.

Alternatively, the expanded, void-containing, high viscosity melt blend may be passed between chilled rollers to shape the extrudate into a thinner, but still void-filled sheet. This sheet is then broken into flattened megaparticles intermediate between plate form and crumb form.

Example 12—Gas Expansion in a Zone of Reduced Pressure

A modification of Examples 10 and 11 is the addition of a region of reduced pressure downstream of the extruder. For example, a chamber that may be evacuated is attached to the exit port of the extruder. The chamber is evacuated below atmospheric pressure, to increase the pressure differential between the inside and outside of the extruder, increasing adiabatic expansion and cooling.

Large-Particle Application Equipment—Megabore

Many megaparticles of the current invention are too large to be applied using conventional powder handling equipment. Even though megaparticles with dimensions of up to 10 mm or larger can have volume-specific surface areas, $S_v$, of greater than 0.024, and can be fluidized, and can be carried on air at the velocities provided by conventional spray equipment, the passages provided in this equipment for the passage and direction of the air/powder mixture are too small to permit passage of such megaparticles. Most gun types have passages with widths less than 5 mm in diameter, and some even less. None are available in which all powder-handling passages are larger than about 6 mm.

An aspect of the current invention of coating megaparticles is invention of equipment modified such that it can fluidize, transfer, spray, and electrostatically charge megaparticles with dimensions greater than 250 microns, such as 300 microns, or 500 microns, or 1 or 2 millimeters, or 10 millimeters, or more. This equipment has internal channels, pumps, tubes and connections with diameters greater than 10 millimeters, and may have internal passages up to about 20 mm or 40 mm or more in diameter, or typical cross section.

Example 14—Equipment with Enlarged Internal Spaces

Many megaparticles could applied using equipment with the following modifications: Particle pick-up tube at least 12 mm in internal diameter, preferably greater than 15 mm; Transfer hoses of at least 12 mm in internal diameter, preferably greater than 15 mm; Venturi pump in which the particle pump chamber is at least 12 mm in internal diameter, preferably greater than 15 mm; Passages around the electrode assembly of at least 12 mm in internal diameter, preferably greater than 15 mm; and Discharge nozzle of at least 12 mm in internal diameter, preferably greater than 15 mm.

Example 15—Addition of Additional Venturis to Powder Pumps

In a modification to provide larger volumes of air carried by larger internal diameters, additional venturis may be added to conventional powder pumps. For example, two, or more venturis may be supplied in place of the one venturi provided in conventional powder pumps. A first embodiment of the invention is a set of coatings and composite structures similar to powder coatings in that they are formed from solid particles applied to workpieces, but different in that they comprise larger-scale variations in structure than can be prepared using conventional powder coating technology.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A confluent system for coating a workpiece with multiple sized particles, the confluent system comprising:

a first subsystem configured to deliver a first stream consisting of small particles to the workpiece; and a second subsystem configured to deliver second stream consisting of large particles to the workpiece, the second subsystem having:

an internal venture;

an open hopper in gaseous communication with the internal venture, the open hopper being configured to receive solid large particles; and a fluid bed in gaseous communication with the internal venture;

wherein coatings and composite structures are formed from a particle set created by combining the first stream consisting of small particles and the second stream consisting of large particles;

wherein the first stream and second stream are applied to the workpiece by gas-supported transfer then fused together by heating, wherein the coatings and composite structures comprise large-scale variations in structure provided by the inclusion of particles that are larger in at least one dimension than conventional powder coating particles, and particles that are larger than about 250 microns.

2. The system of claim 1, wherein the particle set comprises between 0.5 and 100% large solid particles and from 0 and 99.5% conventional powder coating particles.

3. The system of claim 2, wherein the large solid particles comprise fiber particles longer than about 250 microns and two other dimensions less than about 250 microns.

4. The system of claim 2, wherein the large solid particles comprise flake particles with length and breadth larger than about 250 microns and thickness less than about 250 microns.

5. The system of claim 2, wherein the large solid particles comprise foam particles with three dimensions larger than 250 microns, but reduced in density by the inclusion of voids.

6. The system of claim 2, wherein the large solid particles comprise two or more of fiber, flake and foam particles.

7. The system of claim 1, wherein the coatings and composite structures are formed during delivery of the first stream consisting of small particles and delivery of the second stream consisting of small particles to the workpiece.

* * * * *